US012631098B2

(12) United States Patent
Al Afnan et al.

(10) Patent No.: US 12,631,098 B2
(45) Date of Patent: May 19, 2026

(54) GASEOUS HYDROCARBONS FORMATION HEATING DEVICE

(71) Applicant: KING FAHD UNIVERSITY OF PETROLEUM AND MINERALS, Dhahran (SA)

(72) Inventors: Saad Al Afnan, Dhahran (SA); Murtada Al Jawad, Dhahran (SA); Guenther Glatz, Dhahran (SA); Abdullah Sultan, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 462 days.

(21) Appl. No.: 17/589,140

(22) Filed: Jan. 31, 2022

(65) Prior Publication Data

US 2023/0243247 A1 Aug. 3, 2023

(51) Int. Cl.
*E21B 43/24* (2006.01)

(52) U.S. Cl.
CPC ..... *E21B 43/2401* (2013.01)

(58) Field of Classification Search
None
See application file for complete search history.

(56) References Cited

U.S. PATENT DOCUMENTS 8,151,877 B2 4/2012 Kaminsky et al.
8,967,260 B2 3/2015 Kaminsky et al.
9,816,376 B2 11/2017 Pope et al.
(Continued)

FOREIGN PATENT DOCUMENTS

AU 2007313388 B2 1/2013

OTHER PUBLICATIONS

Wang, et al. ; Numerical simulation of enhancing shale gas recovery using electrical resistance heating method ; International Journal of Heat and Mass Transfer vol. 128 ; Jan. 2019 ; pp. 1218-1228 ; Abstract Only ; 2 Pages.
(Continued)

*Primary Examiner* — Anuradha Ahuja
(74) *Attorney, Agent, or Firm* — Oblon, McClelland, Maier & Neustadt, L.L.P.

(57) ABSTRACT

A method of enhanced gaseous hydrocarbons recovery is provided. The method includes placing at least two individual, independently-controllable heating elements aligned opposite one another and in the same location on a production tubing in a wellbore at a gaseous hydrocarbons-producing location of a geological formation to form a permanently-installed array of heating elements. The method also includes heating a portion of the geological formation containing a gaseous hydrocarbons deposit comprising kerogen with a gaseous hydrocarbons formation heating device comprising the permanently-installed array of heating elements, at a temperature sufficient to liberate gaseous hydrocarbons from the kerogen present in the gaseous hydrocarbons deposit and recovering the gaseous hydrocarbons by transporting the gaseous hydrocarbons via the production tubing to the surface. The gaseous hydrocarbons formation heating device comprises a controller configured to control the permanently-installed array of heating elements.

6 Claims, 13 Drawing Sheets

(56) References Cited

U.S. PATENT DOCUMENTS

| | | | | |
|---|---|---|---|---|
| 2002/0029885 | A1* | 3/2002 | de Rouffignac | E21B 43/24 166/57 |
| 2003/0173081 | A1* | 9/2003 | Vinegar | E21B 43/243 166/272.1 |
| 2005/0269095 | A1* | 12/2005 | Fairbanks | E21B 43/2401 166/371 |
| 2012/0325458 | A1 | 12/2012 | El-Rabaa et al. | |
| 2017/0141724 | A1* | 5/2017 | O'Donnell | F24T 10/15 |

OTHER PUBLICATIONS

Zhu, et al. ; The numerical simulation of thermal recovery based on hydraulic fracture heating technology in shale gas reservoir ; Journal of Natural Gas Science and Engineering 28 ; pp. 305-316 ; Nov. 29, 2015 ; 13 Pages.

* cited by examiner

GASEOUS HYDROCARBONS FORMATION HEATING DEVICE

BACKGROUND

Technical Field

The present disclosure relates to a gaseous hydrocarbons formation heating device and more particularly relates to a method of obtaining gaseous hydrocarbons from a gaseous hydrocarbons deposit using the gaseous hydrocarbons formation heating device.

Discussion of Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

Increase in demand for hydrocarbon products has led to a need to obtain and recover the maximum amount of oil and gas from available reservoirs. Thermal enhanced recovery using steam injection, electrical heating, and/or in-situ combustions have shown significant improvements in oil recovery, particularly of heavy crude oil. Processes which involve heating the reservoirs are primarily intended to enhance oil mobility which renders the process most desirable for highly viscous materials such as heavy crude oil. Additionally, the heating can play a role in altering other properties of the heavy oil in favor of enhanced production. However, the equipment and procedures for thermal enhanced recovery of oil and gas from conventional sources may not be applicable to non-conventional oil and gas resources.

For non-conventional resources of oil and gas, large amounts of hydrocarbons can be stored in an organic constituent of a shale matrix known as kerogen. Kerogen is solid, insoluble organic matter that contains a large amount of hydrocarbons in sedimentary rocks of the reservoirs (also known as oil shale). The kerogen needs to be decomposed at high temperature to produce or softened/melted at slightly elevated temperatures to liberate gaseous hydrocarbons that can be recovered easily.

The build-up of pressure inside kerogen pores during hydrocarbons generation results in the formation of microcracks which can be seen in various electron microscopy studies of shale matrix [See: Curtis, E. M.; Influence of thermal maturity on organic shale microstructure; Hou, Y., He, S., Wang, J., Harris, N. B., Cheng, C., Li, Y., Pedersen, P.: Preliminary study on the pore characterization of lacustrine shale reservoirs using low-pressure nitrogen adsorption and field emission scanning electron microscopy methods: a case study of the Upper Jurassic Emuerhe Formation, Mohe basin, northeastern China. Can. J. Earth Sci. 52, 294-306 (2015); Chen, S., Han, Y., Fu, C., Zhang, h., Zhu, Y., Zuo, Z.: Micro and nano-size pores of clay minerals in shale reservoirs: implication for the accumulation of shale gas. Sediment. Geol. 342, 180-190 (2016)]. The microcracks serve as conduits for fluid transport from the organic nanopores to the larger size fracture [See: Alafnan, S. F. K. & Akkutlu, I. Y.: Matrix-Fracture Interactions during Flow in Organic Nanoporous Materials under Loading. Transp Porous Med (2017)].

During production, compressed hydrocarbons undergo continuous expansion and depletion through microcracks shifting the adsorption equilibrium in favor of desorption. The walls of organic nanopores influence the transport mechanisms making a continuum approach of modeling fluid transport insufficient due to a degree of confinement [See: Kang, S. M., Fathi, E., Ambrose, R. J. et al. 2011. Carbon Dioxide Storage Capacity of Organic-Rich Shales. SPE J. 16 (4): 842-855; Josh, M., Esteban, L., Delle Piane, C. et al. 2012. Laboratory Characterisation of Shale Properties. J. Pet. Sci. Eng. 88-89 (June): 107-124]. Various studies have considered the transport of natural gas in nanopores and derived composite advective-diffusive-adsorptive models [See: Javadpour, F.: Nanopores and Apparent Permeability of Gas Flow in Mudrocks (Shales and Siltstone). Journal of Canadian Petroleum Technology. 48, 16-21 (2009); Sakhaee-Pour, A. and Bryant, S.: Gas Permeability of Shale. SPE Reservoir Evaluation & Engineering 15 (04): 401-409; Wasaki, A., Akkutlu, I. Y. (2015). Permeability of organic-rich shale. SPE Journal. 20(06), 1-384; Kou, R., Alafnan, S. F. K., Akkutlu, I. Y.: Multi-scale Analysis of Gas Transport Mechanisms in Kerogen. Transp Porous Med. 116, 493-519 (2017)]. Moreover, surfaces of the kerogen can favor one component over the other which makes the composition of a given mixture vulnerable to continuous changes during the production span.

Various traditional methods used to decompose and/or disrupt the kerogen include In-situ Conversion Process (ICP), steam injection, and inserting electric or gas heaters into separate heating wells at desired geological locations. The heating wells, however, do not aid collection or transport of the gaseous hydrocarbons from the reservoir to the surface. These traditional methods fail to provide desired results because of challenges in achieving stable heating in the well and the fact that multiple heating wells may be required for operation, thereby making the process inefficient and costly. Hence, there exists a need to develop an efficient and easy-to-execute method to obtain the hydrocarbons from the gaseous hydrocarbons deposit.

SUMMARY

According to one aspect of the present disclosure, a method of enhanced gaseous hydrocarbons recovery is disclosed. The method includes placing at least two individual, independently-controllable heating elements on a production tubing in a wellbore at a gaseous hydrocarbons-producing location of a geological formation to form a permanently-installed array of heating elements. The at least two individual, independently-controllable heating elements are aligned opposite to one another and in the same location on the production tubing. The method also includes heating a portion of the geological formation containing a gaseous hydrocarbons deposit, having kerogen with a gaseous hydrocarbons formation heating device that includes the permanently-installed array of heating elements, at a temperature sufficient to liberate gaseous hydrocarbons from the kerogen present in the gaseous hydrocarbons deposit. The gaseous hydrocarbons formation heating device includes a controller to control the permanently-installed array of heating elements. The method further includes recovering the gaseous hydrocarbons by transporting the gaseous hydrocarbons from the production tubing to the surface. The steps of placing, heating, and recovering are free from the introduction of fluid into the geological formation.

In some embodiments, the individual, independently-controllable heating elements are operated to provide the production tubing or the gaseous hydrocarbons deposit a temperature profile that is non-cylindrically symmetrical.

In some embodiments, the gaseous hydrocarbons heating device further includes a plurality of sensors. The plurality of sensors includes at least one sensor selected from a group consisting of: (a) array temperature sensors capable of measuring a temperature profile of the permanently-installed array of heating elements, (b) gaseous hydrocarbons temperature sensors capable of measuring a temperature distribution of gaseous hydrocarbons in the production tubing, and (c) gaseous hydrocarbons flow sensors capable of measuring a gaseous hydrocarbons flow profile into and along with the production tubing.

In some embodiments, the controller receives input from the plurality of sensors and adjusts the temperature profile of the permanently-installed array of heating elements based on the input.

In some embodiments, the method further comprises heating a portion of the production tubing with a production tubing heater comprising a plurality of tube heaters distributed along a length of a portion of production tubing located outside of the portion of the geological formation containing a gaseous hydrocarbons deposit comprising a kerogen.

In some embodiments, the controller adjusts the temperature of the permanently-installed array of heating elements to a defined temperature based on a production metric of the gaseous hydrocarbons deposit.

In some embodiments, the permanently-installed array of heating elements is heated to a temperature of 200° F. to 325° F.

In some embodiments, the method increases the recovery factor of the gaseous hydrocarbons deposit by 5 to 50% compared to a gaseous hydrocarbons deposit which is not heated.

In some embodiments, a bottomhole pressure required to maintain a production rate of the gaseous hydrocarbons deposit heated according to the method is lowered by a value in a range of about 250 PSI to about 1250 PSI compared to a gaseous hydrocarbons deposit which is not heated.

In some embodiments, the gaseous hydrocarbons deposit in a state of production produces gaseous hydrocarbons at a rate of 0.1 million standard cubic feet per day (MMSCFD) to 250 MMSCFD.

In some embodiments, the gaseous hydrocarbons recovered by the method at a bottomhole pressure of 750 psi to 1250 psi includes 50 to 59 mol % methane, 27 to 33 mol % ethane, 10 to 17 mol % butane, and 1 to 3 mol % propane, based on a total number of moles of the gaseous hydrocarbons.

In some embodiments, the method further includes collecting, during times with sunlight, solar energy using a photovoltaic array; distributing solar energy collected by the photovoltaic array to an energy storage device and the permanently-installed array of heating elements using an energy distributor; and providing, from the energy storage device, solar energy to the permanently-installed array of heating elements during times without sunlight. The energy distributor is configured to provide an energy distribution to the permanently-installed array of heating elements so as to maintain a total heating during times with sunlight equal to a total heating during times without sunlight.

According to another aspect of the present disclosure, a gaseous hydrocarbons formation heating device is disclosed. The gaseous hydrocarbons formation heating device includes a permanently-installed array of heating elements disposed on a production tubing and a controller. The permanently-installed array of heating elements includes at least two individual, independently-controllable heating elements controlled by the controller.

In some embodiments, the individual, independently-controllable heating elements are capable of giving the permanently-installed array a temperature profile that is non-cylindrically symmetrical.

In some embodiments, the permanently-installed array of heating elements is capable of being heated to a temperature in a range of about 200° F. to about 325° F.

In some embodiments, the gaseous hydrocarbons formation heating device further includes a plurality of sensors connected to the controller, the sensors being at least one selected from a group consisting of: (a) array temperature sensors, (b) gaseous hydrocarbons temperature sensors, and (c) gaseous hydrocarbons flow sensors.

In some embodiments, the controller receives input from the plurality of sensors and adjusts the temperature profile of the permanently-installed array of heating elements based on the input.

In some embodiments, the gaseous hydrocarbons formation heating device further includes a photovoltaic array disposed at an aboveground location. The aboveground location is located proximal to a wellhead of the production tubing.

In some embodiments, the gaseous hydrocarbons formation heating device also includes an energy storage device, connected to both the photovoltaic array and the permanently-installed array of heating elements.

In some embodiments, the gaseous hydrocarbons formation heating device further includes an energy distributor connected to each of the photovoltaic array, the energy storage device, and the permanently-installed array of heating elements. The energy distributor is configured to: (a) distribute energy collected by the photovoltaic array, during times of sunlight, to the energy storage device and the permanently-installed array of heating elements, and (b) distribute energy from the energy storage device to the permanently-installed array of heating elements during times without sunlight.

In some embodiments, the energy distributor provides an energy distribution to the permanently-installed array of heating elements to maintain a total heating during times with sunlight equal to a total heating during times without sunlight.

These and other aspects of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
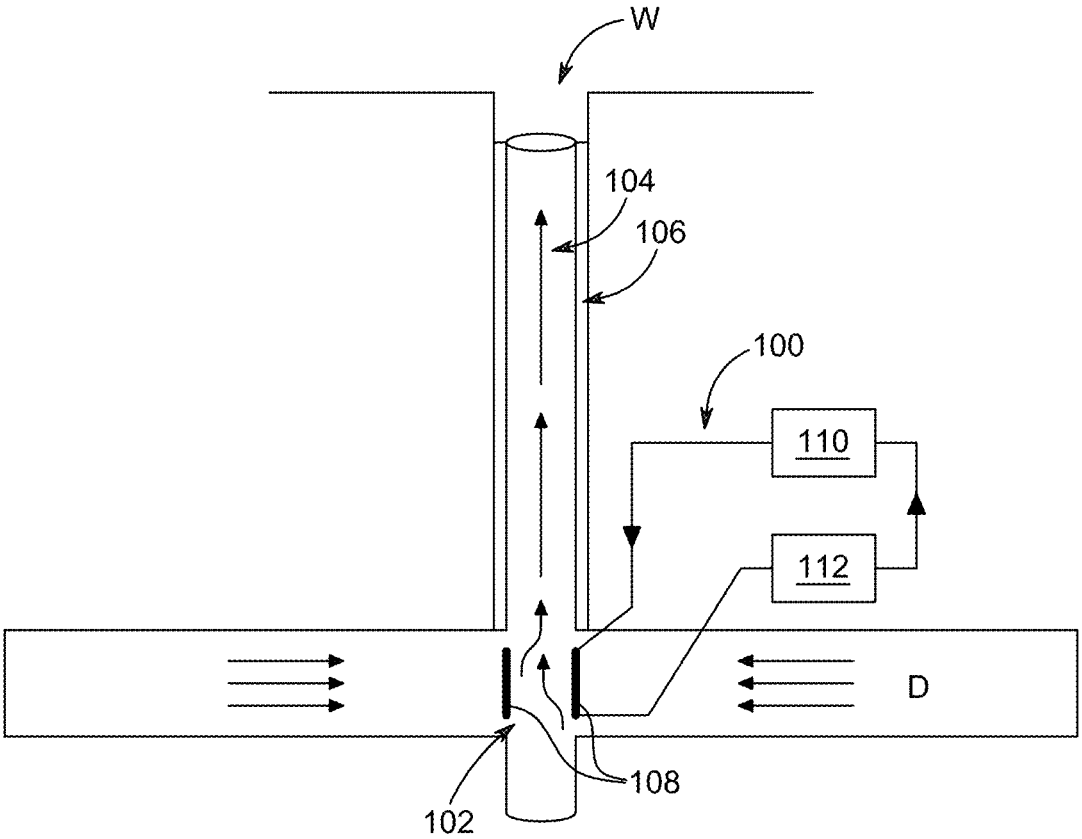
FIG. 1 illustrates a schematic diagram of a gaseous hydrocarbons formation heating device placed in a wellbore, according to an aspect of the present disclosure.

In the following description, it is understood that other embodiments may be utilized, and structural and operational changes may be made without departure from the scope of the present embodiments disclosed herein.

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

In the drawings, like reference numerals designate identical or corresponding parts throughout the several views. Further, as used herein, the words "a," "an" and the like generally carry a meaning of "one or more," unless stated otherwise.

Furthermore, the terms "approximately," "approximate," "about," and similar terms may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), +/−15% of the stated value (or range of values), or +/−20% of the stated value (or range of values). Within the description of this disclosure, where a numerical limit or range is stated, the endpoints are included unless stated otherwise. Also, all values and subranges within a numerical limit or range are specifically included as if explicitly written out.

As used herein, "wellbore completions" refers to the set of downhole tubulars and equipment, including above ground equipment such as valves, gauges and chokes that permit adjustments in flow control or hydrocarbon production as well as injections to stimulate production, required to enable safe and efficient production from an oil or gas well.

As used herein, "kerogen" refers to solid organic matter present in sedimentary rocks. Kerogen is a complex mixture of organic chemical compounds and as such does not have a specific chemical formula. It is instead described by an elemental composition, typically relative composition, of carbon, hydrogen, oxygen, nitrogen, and sulfur. Kerogen is differentiated from bitumen by solubility in common organic solvents with bitumen being soluble and kerogen being insoluble. Kerogen typically comprises micropores and nanopores in which hydrocarbons (liquid or gas) may be contained. Disruption of the kerogen, for example by physical or thermal means, can liberate such trapped hydrocarbons. Additionally, thermal treatment of kerogen (also known as thermal upgrading or retorting) can decompose the constituent molecules of the kerogen (crack) into smaller hydrocarbon molecules such as liquid hydrocarbons such as petroleum or gaseous hydrocarbons.

FIG. 1 illustrates a schematic diagram of a gaseous hydrocarbons formation heating device 100 (hereinafter referred to as "the heating device 100") placed in a wellbore "W", according to an embodiment of the present disclosure. The heating device 100 includes a permanently-installed array of heating elements 102 (alternatively referred to as "the array of heating elements 102") disposed on a production tubing 104. The production tubing 104 is embodied as a long cylindrical hollow pipe used in the wellbore "W" through which production fluids are obtained onto the surface (such as, land surface) from a subterranean hydrocarbon reservoir (not shown). The production tubing 104 is disposed in a wellbore casing 106 of the wellbore "W". In some embodiments, the production tubing 104 may be one of a tube, a pipe, a duct, or a conduit. The production tubing 104 protects the wellbore casing 106 from wear, tear, corrosion, and deposition of by-products, such as sand/silt, paraffin, and asphaltenes. In some embodiments, the production tubing 104 may be disposed in a vertical wellbore. In some embodiments, the production tubing 104 may be disposed in a lateral or horizontal wellbore.

The array of heating elements 102 includes at least two individual, independently-controllable heating elements 108. The array of heating elements 102 are located on a circumference of the production tubing 104. In some embodiments, the array of heating elements 102 may be located on an inner surface of the production tubing 104. In some embodiments, the array of heating elements 102 may be located on an outer surface of the production tubing 104. In some embodiments, the array of heating elements 102 may be ohmic heating elements. Ohmic heating elements, also known as resistive heating elements or joule heating elements, operate by passing an electric current through a conductor. The temperature of the array of heating elements 102 may be controlled by adjusting the parameters of the electric current passing therethrough.

In some embodiments, the individual, independently-controllable heating elements of the array are made of metal, a ceramic semiconductor, a polymer, or some other type of heating element known to those of ordinary skill in the art. The heating elements may be in the form of wires, ribbons, plates, discs, foils, tubes, coils, or the like. Metal heating elements may be formed from metals or metal alloys such as nichrome 80/20 (an alloy comprising 80 wt % nickel and 20 wt % chromium based on a total weight of nichrome alloy), Kanthal (an alloy of iron, chromium, and aluminum), and cupronickel (an alloy of copper and nickel). Ceramic semiconductor heating elements may be formed from semiconducting ceramic materials that display a positive thermal coefficient (PTC) such as bismuth-, lanthanum-, samarium-, antimony-, or niobium-doped barium titanate, aluminum- or chromium-doped vanadium oxide, molybdenum disilicide, and silicon carbide.

In some embodiments, the individual, independently-controllable heating elements have a length of 1 mm to 76.2 m (250 ft), preferably 2 mm to 70 m, preferably 1 cm to 65 m, preferably 10 cm to 60 m, preferably 50 cm to 50 m, preferably 1 m to 25 m. In some embodiments, the individual, independently-controllable heating elements have a width of 1 mm to 53.36 cm, preferably 2 mm to 39 cm, preferably 5 mm to 28 cm, preferably 1 cm to 24 cm, preferably 5 cm to 15 cm. In some embodiments, the individual, independently-controllable heating elements are separated along the length of the array by 5 to 100% of the length of the individual, independently-controllable heating elements, preferably 10 to 90%, preferably 25 to 75%, preferably 50% of the length of the individual, independently-controllable heating elements. In some embodiments, the individual, independently-controllable heating elements are separated along a circumference or perimeter of the array by 5 to 100% of the width of the individual, independently-controllable heating elements, preferably 10 to 90%, preferably 25 to 75%, preferably 50% of the width of the individual, independently-controllable heating elements. In some embodiments, the individual, independently-controllable heating elements are spaced along the length of the array in a uniform manner, that is, the spacing between individual, independently-controllable heating elements is same for all individual, independently-controllable heating elements along the length of the array of heating elements. In alternative embodiments, the individual, independently-controllable heating elements are not spaced along the length of the array in a uniform manner. In such embodiments, there may be portions of the array in which the spacing between adjacent individual, independently-controllable heating elements along the length of the array is made larger. Such larger spacings may be left to allow gaseous hydrocarbons to enter the interior of the array or production pipe. Such larger spacings may have additional equipment placed such as tubes that allow gaseous hydrocarbons to flow into the interior of the array or production pipe without contacting the individual, independently-controllable heating elements. In some embodiments, the individual, independently-controllable heating elements are spaced along the circumference or perimeter of the array in a uniform manner, that is, the spacing between individual, independently-controllable heating elements is same for all individual, independently-controllable heating elements along the circumference or perimeter of the array of heating elements. In alternative embodiments, the individual, independently-controllable heating elements are not spaced along the circumference or perimeter of the array in a uniform manner. In such embodiments, there may be portions of the array in which the spacing between adjacent individual, independently-controllable heating elements along the circumference or perimeter of the array is made larger. Such larger spacings may be left to allow gaseous hydrocarbons to enter the interior of the array or production pipe. Such larger spacings may have additional equipment placed such as tubes that allow gaseous hydrocarbons to flow into the interior of the array or production pipe without contacting the individual, independently-controllable heating elements.

The array of heating elements 102 are provided at a geographical region with the help of the production tubing 104 to heat a gaseous hydrocarbons deposit "D" present in the wellbore "W". The gaseous hydrocarbons deposit "D" includes kerogen, an organic compound containing hydrocarbons in abundance. Heating of the gaseous hydrocarbons deposit "D" may result in a decomposition or cracking of the kerogen, generating the gaseous hydrocarbons. The heating of the gaseous hydrocarbons deposit "D" may result in a disruption of the kerogen matrix. This disruption may include melting or softening. The disruption may cause release of trapped gaseous hydrocarbons which are present in micropores and/or nanopores present in the kerogen matrix. The gaseous hydrocarbons may then be transferred through cracks or fractures produced in the reservoir to the production tubing 104 and onto the surface. In some embodiments, the individual, independently-controllable heating elements 108 are configured to generate a temperature profile that is non-cylindrically symmetrical. As used herein, the term "non-cylindrically symmetrical" refers to a non-uniform distribution of temperature along the circumference of the production tubing 104. For example, when one heating element is actuated and the other heating element is not actuated, the temperature of a portion of the production tubing 104 proximal to the actuated heating element is higher as compared to region proximal to the other heating element. Such instances result in asymmetrical distribution or the non-uniform distribution of temperature. The at least two individual, independently-controllable heating elements 108 may be heated together or as per the requirement in the geographical region and the position of the gaseous hydrocarbons deposit "D".

In some embodiments, the geological formation containing a shale deposit to be heated by the method comes into direct contact with a portion of the gaseous hydrocarbons formation heating device configured to contact the geological formation. In some embodiments, the portion of the gaseous hydrocarbons formation heating device configured to contact the geological formation comprises the heating elements. In some embodiments, the portion of the gaseous hydrocarbons formation heating device configured to contact the geological formation comprises a protective covering placed around one or more of the heating elements. In some embodiments, the protective covering prevents the geological formation from contacting the heating elements directly. In some embodiments, the protective covering is heated by the heating elements and acts as a heat transfer material to transfer heat from the heating elements to the geological formation. Examples of heat transfer materials are metals such as steel, aluminum, and copper, and ceramics such as molybdenum disilicide, silicon carbide, barium titanate, and aluminum nitride. In some embodiments, the heat transferred to the geological formation is then transferred to the kerogen. In some embodiments, the kerogen and/or gaseous hydrocarbons does not come into direct contact with any portion of the gaseous hydrocarbons formation heating device.

In some embodiments, the kerogen and/or gaseous hydrocarbons to be heated by the method comes into direct contact with a portion of the gaseous hydrocarbons formation heating device configured to contact kerogen and/or gaseous hydrocarbons. In some embodiments, the portion of the gaseous hydrocarbons formation heating device configured to contact kerogen and/or gaseous hydrocarbons comprises the heating elements. In some embodiments, the portion of the gaseous hydrocarbons formation heating device configured to contact kerogen and/or gaseous hydrocarbons comprises a protective covering placed around one or more heating elements. In some embodiments, the protective covering prevents kerogen and/or gaseous hydrocarbons from contacting the heating elements directly. In some embodiments, the protective covering is heated by the heating elements and acts as a heat transfer material to transfer heat from the heating elements to the kerogen and/or gaseous hydrocarbons. Examples of heat transfer materials include heat transfer materials as described above. In some embodiments, the kerogen and/or gaseous hydrocarbons does not contact the gaseous hydrocarbons formation heating device.

In some embodiments, the gaseous hydrocarbons formation heating device also heats a portion of the wellbore that is not the geological formation. Examples of such portions include, but are not limited to, wellbore casings, wellbore cement, and wellbore completions. In some embodiments, the gaseous hydrocarbons heating device also heats a portion of the production pipe.

The method preferably does not involve heating the kerogen, gaseous hydrocarbons, and/or the geological formation by combustion of the kerogen and/or gaseous hydrocarbons or a component thereof within the geological formation, production pipe, or other wellbore. The method preferably does not involve the use of a heater well. The method does not involve heating the kerogen and/or gaseous hydrocarbons or the geological formation by the introduction of steam or other fluid having a temperature greater than the temperature of the kerogen and/or gaseous hydrocarbons or the geological formation. The method also preferably does not involve heating the kerogen and/or gaseous hydrocarbons or the geological formation by the passing of an electric current through the kerogen or a fluid in the geological formation containing the gaseous hydrocarbons deposit. The method preferably does not involve a flow of any fluid through the production tubing into the geological formation. It should be noted here that such flow or introduction of fluid during the steps of the method does not refer to the introduction of fluid related to drilling or well completion activities or pre-method hydraulic fracturing.

In some embodiments, the array of heating elements 102 is heated to a temperature value in a range of about 175° F. to about 350° F., preferably about 185° F. to about 340° F., preferably about 195° F. to about 330° F., preferably about 200° F. to about 325° F., preferably about 220 to about 320° F., preferably about 220 to about 315° F., preferably about 230 to about 310° F., preferably about 240 to about 305° F., preferably about 250 to about 300° F., preferably about 260 to about 295° F., preferably about 280 to about 290° F. In some embodiments, the array of heating elements 102 or a portion of the array is temporarily removed for purposes such as, but not limited to, repairing, testing, or other maintenance. In some embodiments, the array of heating elements 102 may be in the form of wires, ribbons, cubes, plates, discs, foils, tubes, coils, or the like. In some embodiments, each heating element of the array of heating elements 102 may be placed equidistant from an adjacent heating element such that a space between two heating elements may have perforations that enable the gaseous hydrocarbons to flow through the array of heating elements 102 and into the production tubing 104.

As used herein, "permanently-installed" means in place for an entire production lifetime of a gaseous hydrocarbons well. While a permanently-installed tool or device may be temporarily removed for purposes such as maintenance, it should be returned to place after said maintenance is performed. Preferably, the gaseous hydrocarbons well is placed in a state of not producing during said maintenance. The permanently-installed array of heating elements is preferably in place before production begins and when production is permanently ceased. In some embodiments, the permanently-installed array of heating elements is not permanently removed from the wellbore. In some embodiments, the permanently-installed array of heating elements or a portion of the array is temporarily removed for purposes such as repair, testing, or other maintenance, but the array is preferably replaced after such removal. In some embodiments, the permanently-installed array of heating elements is installed during wellbore completion. In some embodiments, the permanently-installed array of heating elements is removed during well abandonment or decommissioning. In some embodiments, the permanently-installed array of heating elements is not removed during well abandonment or decommissioning. In some embodiments, the permanently-installed array of heating elements is installed outside of a wellbore casing. In such embodiments, the permanently-installed array of heating elements may be cemented into place. In embodiments where the permanently-installed array of heating elements is installed outside of the wellbore casing, the permanently-installed array of heating elements may be in contact with or attached to the wellbore casing. In some embodiments, the permanently-installed array of heating elements may be installed inside the wellbore casing. In such embodiments, the permanently-installed array of heating elements may be in contact with or attached to the wellbore casing. In alternative embodiments, the permanently-installed array of heating elements is attached to a wellbore tubular inside of the wellbore casing but not in contact with the wellbore casing. In some embodiments, the permanently-installed array of heating elements is installed in a portion of the wellbore without a wellbore casing. In such embodiments, the permanently-installed array of heating elements may be disposed upon or attached to the geological formation. In some embodiments, the permanently-installed array of heating elements may be attached to a separate portion of the wellbore in the uncased portion such as a sand screen or gravel pack. In some embodiments, the permanently-installed array of heating elements is disposed upon or attached to a wellbore annulus. Preferably, the permanently-installed array of heating elements is not attached to a portion of wellbore or wellbore equipment which moves, such as a sucker rod, plunger, or pumpjack.

In some embodiments, the method further comprises heating a portion of the production tubing with a production tubing heater comprising a plurality of tube heaters distributed along a length of a portion of production tubing located outside of the portion of the geological formation containing a gaseous hydrocarbons deposit comprising a kerogen, e.g., distanced from the permanently-installed array of heating elements by at least 10 m, preferably 100 m, 250 m or at least 500 m. The production tubing heater may be heated to a temperature similar to the permanently-installed array of heating elements. In some embodiments, the production tubing heater may be heated to a temperature above that of the permanently-installed array of heating elements, e.g., a temperature at least 50° C. preferably at least 100° C. or 150° C. above that of the permanently-installed array of heating elements. The production tubing heater is preferably placed downstream of the permanently-installed array of heating elements. That is, the production tubing heater is placed in or along the production tubing at a location such that gaseous hydrocarbons flow from the geological formation into the production tubing and leave an area defined by the permanently-installed array of heating elements before encountering the production tubing heater and before being collected. Preferably no other equipment or constriction is disposed in the production tubing between the section containing the permanently-installed array of heating elements to the section containing the production tubing heater. In some embodiments, the tube heaters are ring-shaped. Such ring-shaped heaters provide the production tubing with a heating profile which is cylindrically symmetrical. In some embodiments, the production tubing heater does not contact the geological formation. In embodiments in which more than one permanently-installed array of heating elements is used (e.g. where a single production tube encounters more than one kerogen-containing zones), a production tubing heater may be disposed between multiple arrays of heating elements. In such embodiments, the production tubing heaters may be placed such that the production tubing heaters are only located in between kerogen-containing zones. In some embodiments in which more than one permanently-installed array of heating elements is used, a single production tubing heater may be placed at a location downstream of the entirety of the kerogen-containing zones (e.g. past the last of such zones, closer to the wellhead). In general, the production tubing heater may heat any suitable length of production tubing.

The production tubing heater may be advantageous for maintaining a flow of gaseous hydrocarbons through the production tubing. The production tubing heater may be further advantageous for maintaining a performance metric of the well such as the production rate or bottomhole pressure as described below. The production tubing heater may be advantageous for decomposing or converting to gaseous hydrocarbons kerogen which may be present in the production tubing. Such kerogen present may be present intentionally or unintentionally within the production tubing. Decomposing such kerogen may be advantageous for, for example, increasing gaseous hydrocarbon recovery or maintaining the production tubing free of obstructions.

In some embodiments, the permanently-installed array of heating elements is installed in a vertical wellbore. In alternative embodiments, the permanently-installed array of heating elements is installed in a lateral wellbore. In some embodiments, the permanently-installed array of heating elements has a length greater than the extent of a kerogen-containing zone in which the permanently-installed array of heating elements operates. In alternative embodiments, the permanently-installed array of heating elements has a length less than the extent of the kerogen-containing zone in which the permanently-installed array of heating elements operates. In some embodiments, only a single permanently-installed array of heating elements is used. In some embodiments, a gaseous hydrocarbons heating device contains only one permanently-installed array of heating elements. In alternative embodiments, an gaseous hydrocarbons heating device contains multiple permanently-installed arrays of heating elements. In such embodiments, the arrays may be continuous, that is, not separated by a portion of wellbore or wellbore tubular. In some embodiments, the arrays may be discontinuous, that is, separated by a portion of wellbore or wellbore tubular not containing such an array. In some embodiments, multiple gaseous hydrocarbons heating devices may be used. In embodiments with multiple permanently-installed arrays of heating elements, the multiple arrays may be placed adjacent to each other, that is, along the length of the wellbore or wellbore tubular with no separation. In alternative embodiments, the multiple arrays may be separated along the length of the wellbore or wellbore tubular.

In some embodiments, the gaseous hydrocarbons deposit may have more than one kerogen-containing zone. In such embodiments, one gaseous hydrocarbons heating device may be used. In such embodiments, the single gaseous hydrocarbons heating device may be of any length so long as a portion of the single gaseous hydrocarbons heating device is located in each of the kerogen-containing zones. Alternatively, more than one gaseous hydrocarbons heating device may be used. In such embodiments, there is no restriction on the number or length of the gaseous hydrocarbons heating devices so long as a portion of at least one permanently-installed array of heating elements of at least one gaseous hydrocarbons heating device is located in each kerogen-containing zone. In embodiments in which more than one gaseous hydrocarbons heating device is used, the gaseous hydrocarbons heating devices may be operated independently.

The heating device 100 further includes a controller 110 configured to control the array of heating elements 102. The controller 110 may be positioned proximal to the array of heating element 102 or may be positioned at the land surface, for example in a housing, to aid manual operability. In some embodiments, the controller 110 may be connected to a computational device to generate visuals and provide information about the array of heating elements 102 and the parameters of the gaseous hydrocarbons flowing through the production tubing 104. Based on the requirement at the gaseous hydrocarbons deposit "D" the controller 110 may provide energy to heat up either of the at least two individual, independently-controllable heating elements 108 or both together. The controller 110 may be connected to an external battery supply to generate the power to heat up the array of heating elements 102. In embodiments in which more than one array is used, the arrays may be operated independently. In such embodiments, the arrays may be operated independently by a single controller. In alternative embodiments, the arrays may be operated independently by different controllers.

The heating device 100 also includes a plurality of sensors 112 connected to the controller 110. The plurality of sensors 112 is alternatively referred to as "the sensor(s) 112". The sensors 112 include at least one sensor selected from the group consisting of: (a) array temperature sensors, (b) gaseous hydrocarbons temperature sensors, and (c) gaseous hydrocarbons flow sensors. The array temperature sensors are designed to measure the temperature of the array of heating elements 102 and are positioned proximal to the array of heating elements 102. The gaseous hydrocarbons temperature sensor is designed to measure the temperature of the gaseous hydrocarbons obtained from the gaseous hydrocarbons deposit "D" and entering the production tubing 104 and is positioned proximal to the array of heating elements 102. The gaseous hydrocarbons flow sensor is designed to measure the flow parameters of the gaseous hydrocarbons entering the production tubing 104 and inside the production tubing 104 and is positioned proximal to the array of heating elements 102. In some embodiments, the gaseous hydrocarbons flow sensor may be located at multiple locations around the array of heating element 102 to provide an input to the controller 110.

In some embodiments, the controller 110 receives the input from the sensors 112 and adjusts the temperature profile of the array of heating elements 102 based on the input. During operation, the sensors 112 are configured to detect the change in parameters, such as temperature, pressure, and the gas flow rate, around the array of heating elements 102. If the temperature of the array of heating elements 102 fluctuates from the desired temperature, the sensors 112 generates the input and the controller 110 is configured to regulate the temperature of the array of heating elements 102 as per the requirements. The temperature profile of the array of heating elements 102 is continuously monitored and regulated by the controller 110 based on the input from the sensors 112.

Figure 2:
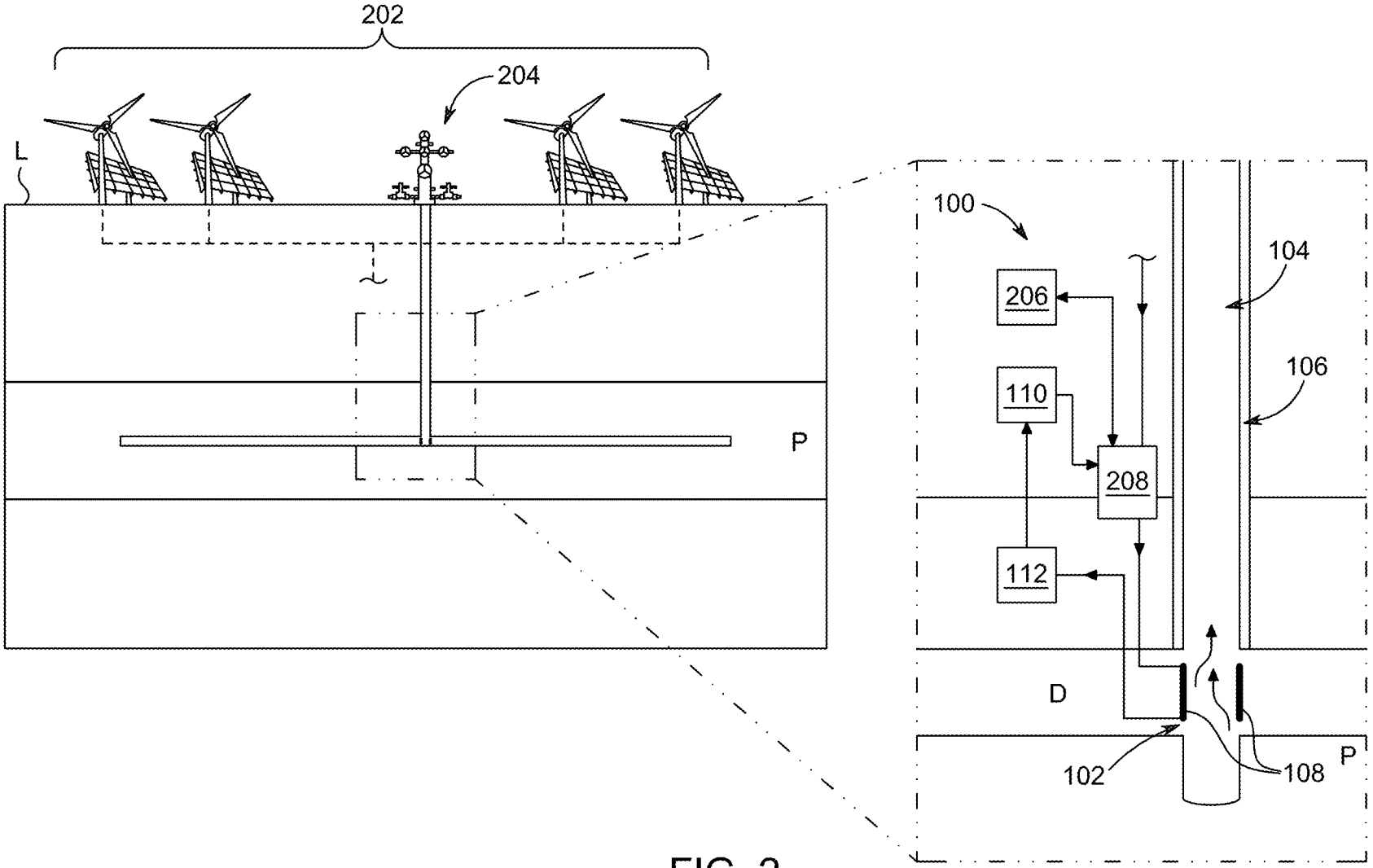
FIG. 2 illustrates an exemplary wellbore operation using the gaseous hydrocarbons formation heating device, according to an aspect of the present disclosure.

FIG. 2 illustrates an exemplary wellbore operation using the heating device 100. In some embodiments, the heating device 100 includes a photovoltaic array 202 disposed at the land surface "L". The land surface "L" includes a wellhead 204 of the production tubing 104. The photovoltaic array 202 is configured to absorb the solar energy and convert the solar energy into the electrical energy. The photovoltaic array 202 provides energy to the heating device 100 and a wellbore operation unit (not shown). In some embodiments, thermal parameters associated with the photovoltaic array 202 are as shown in Table 1.

TABLE 1

| | | |
|---|---|---|
| Gas Specific Heat Capacity | Cp (KJ/Kg ° C.) | 2.2 |
| Reservoir Temperature | T (° C.) | 93.3 |
| Reservoir Pressure | p (psi) | 5000 |
| Gas Formation Volume Factor | Bg($ft^3$/SCF) | 0.0032486 |
| Gas Density | Rho (Kg/m3) | 350 |

FIG. 2 also shows a pay zone "P" including multiple kerogen-containing zones that are heated with the help of the array of heating elements 102. Heat travels through various cracks and fractures present in the gaseous hydrocarbons deposit "D" to heat up the kerogen and release the gaseous hydrocarbons. FIG. 2 also illustrates an enlarged portion of a section 'A'. In some embodiments, the heating device 100 includes an energy storage device 206 connected to the photovoltaic array 202 and the array of heating elements 102. The energy storage device 206 is configured to store the electrical energy collected from the photovoltaic array 202 and provide the electrical energy to the array of heating elements 102. The heating device 100 further includes an energy distributor 208 connected to the photovoltaic array 202, the energy storage device 206, and the array of heating elements 102. In some embodiments, the energy distributor 208 is configured to distribute the energy collected from the photovoltaic array 202 to the energy storage device 206 and the array of heating elements 102 during times of sunlight. During times with sunlight, the photovoltaic array 202 collects the solar energy and transports it through the energy distributor 208 to the energy storage device 206 and the array of heating elements 102.

In some embodiments, the energy distributor 208 is configured to distribute energy from the energy storage device 206 to the array of heating elements 102 during times without sunlight. When the sunlight is not available, the energy stored in the energy storage device 206 during the times when sunlight was present, is utilized to actuate the array of heating elements 102. In some embodiments, the energy distributor 208 is configured to provide an energy distribution to the array of heating elements 102 to maintain a total heating during times with sunlight equal to a total heating during times without sunlight. The array of heating element 102, the controller 110, the sensor 112, the photovoltaic array 202, the energy storage device 206, and the energy distributor 208 collective constitutes the heating device 100.

During operation, the array of heating elements 102 heats the gaseous hydrocarbons deposit "D" to obtain the gaseous hydrocarbons and transfers the gaseous hydrocarbons through the production tubing 104 to the wellhead 204. The sensors 112 sense a value of the temperature of the array of heating elements 102, the temperature of the gaseous hydrocarbons, and the flow profile of the gaseous hydrocarbons to the controller 110. The controller 110 maintains the temperature of the array of heating elements 102 as per the requirement. The controller 110 is connected to the energy distributor 208 that supplies the energy from the photovoltaic array 202 and the energy storage device 206 to the array of heating elements 102. In one exemplary embodiment, the array of heating elements 102 may be configured to operate in a temperature range of about 200° F. to about 325° F., preferably about 220 to about 320° F., preferably about 220 to about 315° F., preferably about 230 to about 310° F., preferably about 240 to about 305° F., preferably about 250 to about 300° F., preferably about 260 to about 295° F., preferably about 280 to about 290° F. If the temperature of the array of heating elements 102 falls below a threshold temperature value of 200° F., the sensor 112 senses the fall in the temperature value and generate a corresponding input. Upon receiving such input, the controller 110 actuates the energy distributor 208 to increase the supply of energy to the array of heating elements 102. When the temperature of the heating elements 102 reaches an upper value of 300° F., the controller 110 is configured to cut off the supply of energy from the energy distributor 208 to the array of heating elements 102 and divert the energy to the energy storage device 206.

Figure 3:
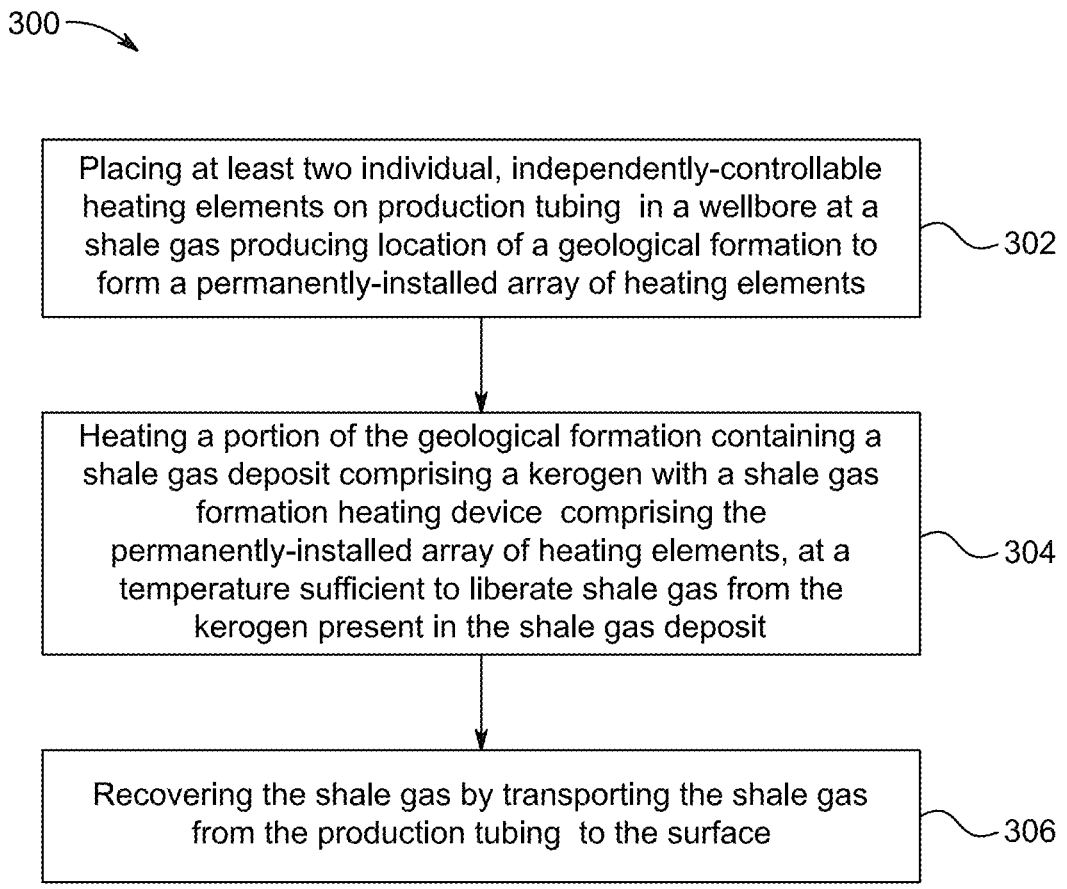
FIG. 3 illustrates a flowchart of a method of gaseous hydrocarbons recovery, according to an aspect of the present disclosure.

FIG. 3 illustrates a flowchart of a method 300 of gaseous hydrocarbons recovery, according to an embodiment of the present disclosure. The method 300 is described with reference to FIG. 1 and FIG. 2. At step 302, the method 300 includes placing at least two individual, independently-controllable heating elements 108 on the production tubing 104 in the wellbore "W" at a gaseous hydrocarbons-producing location of a geological formation to form the array of heating elements 102. The at least two individual, independently-controllable heating elements 108, are positioned such that they are aligned opposite one another and in the same location on the production tubing 104. In some embodiments, the array of heating elements 102 may be configured to generate a non-cylindrically symmetrical temperature profile at the production tubing 104 or the gaseous hydrocarbons deposit "D". In some embodiments, the array of heating elements 102 may have more than two heating elements disposed equidistant from each other. In some embodiments, the array of heating elements 102 may be heated to a temperature value in a range of about 200° F. to about 325° F., preferably about 220 to about 320° F., preferably about 220 to about 315° F., preferably about 230 to about 310° F., preferably about 240 to about 305° F., preferably about 250 to about 300° F., preferably about 260 to about 295° F., preferably about 280 to about 290° F.

At step 304, the method 300 includes heating a portion of the geological formation containing the gaseous hydrocarbons deposit "D" comprising the kerogen with the heating device 100. The heating device 100 includes the array of heating elements 102, operated at a temperature sufficient to liberate the gaseous hydrocarbons from the kerogen present in the gaseous hydrocarbons deposit "D". The heat produced by the array of heating elements 102 travels through the cracks and fractures to heat up the gaseous hydrocarbons deposit "D" and releases the gaseous hydrocarbons by decomposition of kerogen compounds. The gaseous hydrocarbons travels through the cracks and fractures to the production tubing 104 and further to the wellhead 204. The heating device 100 also includes the controller 110 configured to control the array of heating elements 102. In some embodiments, the controller 110 may be located proximal to the array of heating elements 102. In some embodiments, the controller 110 may be located at the land surface near the wellhead 204.

At step 306, the method 300 includes recovering the gaseous hydrocarbons by transporting the gaseous hydrocarbons from the production tubing 104 to the surface. The recovered gaseous hydrocarbons may be further subjected to treatment, storage, and transportation. In some embodiments, the method 300 increases a recovery factor of the gaseous hydrocarbons deposit "D" by about 5% to about 50%, preferably about 10% to about 45%, preferably about 15% to about 40%, compared to a gaseous hydrocarbons deposit which is not heated. In some embodiments, the gaseous hydrocarbons deposit "D", in a state of production, produces gaseous hydrocarbons at a rate of about 0.1 million standard cubic feet per day of gas (MMSCFD) to about 250 MMSCFD, preferably about 1 to about 200 MMSCFD, preferably about 2.5 to about 175 MMSCFD, preferably about 5 to about 150 MMSCFD, preferably about 7.5 to about 125 MMSCFD, preferably about 10 to about 100 MMSCFD.

In some embodiments, a bottomhole pressure required to maintain a production rate of the gaseous hydrocarbons deposit "D" heated according to the method 300 is lowered by about 250 psi to about 1250 psi, preferably about 400 psi to about 1100 psi, preferably about 550 psi to about 950 psi compared to a gaseous hydrocarbons deposit which is not heated.

A balance of pressure and temperature is necessary to obtain a high recovery of the gaseous hydrocarbons from the gaseous hydrocarbons deposit "D". In some embodiments, the pressure may be regulated by a pressure regulating unit including a pressure sensor to sense the pressure at the gaseous hydrocarbons deposit "D" and an operating unit configured to regulate the bottomhole pressure. The pressure sensor may be located proximal to the array of heating elements 102 and the operating unit may be located at the land surface "L" and proximal to the wellhead 204.

In some embodiments, the gaseous hydrocarbons recovered by the method 300 at a bottomhole pressure of 750 psi to 1250 psi includes about 45 mol % to about 64 mol % methane, preferably about 50 mol % to about 59 mol % methane, preferably about 55 mol % methane, based on a total number of moles of gaseous hydrocarbons. In some embodiments, the gaseous hydrocarbons recovered by the method 300 at a bottomhole pressure of 750 psi to 1250 psi includes about 24 mol % to about 36 mol % ethane, preferably about 27 mol % to about 33 mol % ethane, preferably about 30 mol % ethane, based on a total number of moles of gaseous hydrocarbons. In some embodiments, the gaseous hydrocarbons recovered by the method 300 at a bottomhole pressure of 750 psi to 1250 psi includes about 7 mol % to about 20 mol % butane, preferably about 10 mol % to about 17 mol % butane, preferably about 14 mol % butane, based on a total number of moles of gaseous hydrocarbons. In some embodiments, the gaseous hydrocarbons recovered by the method 300 at a bottomhole pressure of 750 psi to 1250 psi includes about 0.5 mol % to about 3.5 mol % propane, preferably about 1 mol % to about 3 mol % propane, preferably about 2 mol % propane based on a total number of moles of gaseous hydrocarbons. In some embodiments, the gaseous hydrocarbons recovered by the method 300 at a bottomhole pressure of 750 psi to 1250 psi includes about 45 mol % to about 64 mol % methane, about 24 mol % to about 36 mol % ethane, about 7 mol % to about 20 mol % butane, and about 0.5 mol % to about 3.5 mol % propane, based on a total number of moles of gaseous hydrocarbons. In some embodiments, the gaseous hydrocarbons recovered by the method 300 at a bottomhole pressure of 750 psi to 1250 psi includes about 50 mol % to about 59 mol % methane, about 27 mol % to about 33 mol % ethane, about 10 mol % to about 17 mol % butane, and about 1 mol % to about 3 mol % propane, based on a total number of moles of gaseous hydrocarbons. In some embodiments, the gaseous hydrocarbons recovered by the method at a bottom hole pressure of 750 psi to 1250 psi includes about 55 mol % methane, about 30 mol % ethane, about 14 mol % butane, and about 2 mol % propane, based on a total number of moles of gaseous hydrocarbons.

The method 300 provides a simple and desirable way to recover the gaseous hydrocarbons from the gaseous hydrocarbons deposit "D". The method 300 utilizes the pressure-temperature regulation to achieve the desired results with a high rate of recovery of the gaseous hydrocarbons. The heating device 100 of the present disclosure provides the ease of handling the gaseous hydrocarbons with minimal operating efforts. The array of heating elements 102 disposed on the production tubing 104 avoids any need for additional heating wells to heat the gaseous hydrocarbons deposit "D". The method 300 provides the heating and the recovery of the gaseous hydrocarbons via the same path, that is the production tubing 104, thereby rendering the process cost-friendly. Since the method 300 utilizes the conventional source of energy via the photovoltaic array 202, requirement of additional energy sources may be substantially reduced or eliminated. The method 300 of the present disclosure increases the recovery factor by about 50% compared to the non-heated recovery.

As used herein, the terms "a" and "an" and the like carry the meaning of "one or more."

Obviously, numerous modifications and variations of the present invention are possible in light of the above teachings. It is, therefore, to be understood that, within the scope of the appended claims, the invention may be practiced otherwise than as specifically described herein.

EXAMPLES

The present disclosure will now be illustrated with examples, which are intended to illustrate the working of aspects of the present disclosure and not intended to imply any limitations on the scope of the present disclosure.

Example 1

Molecular Simulation Approach to Obtain the Shale Gas.

Figure 4:
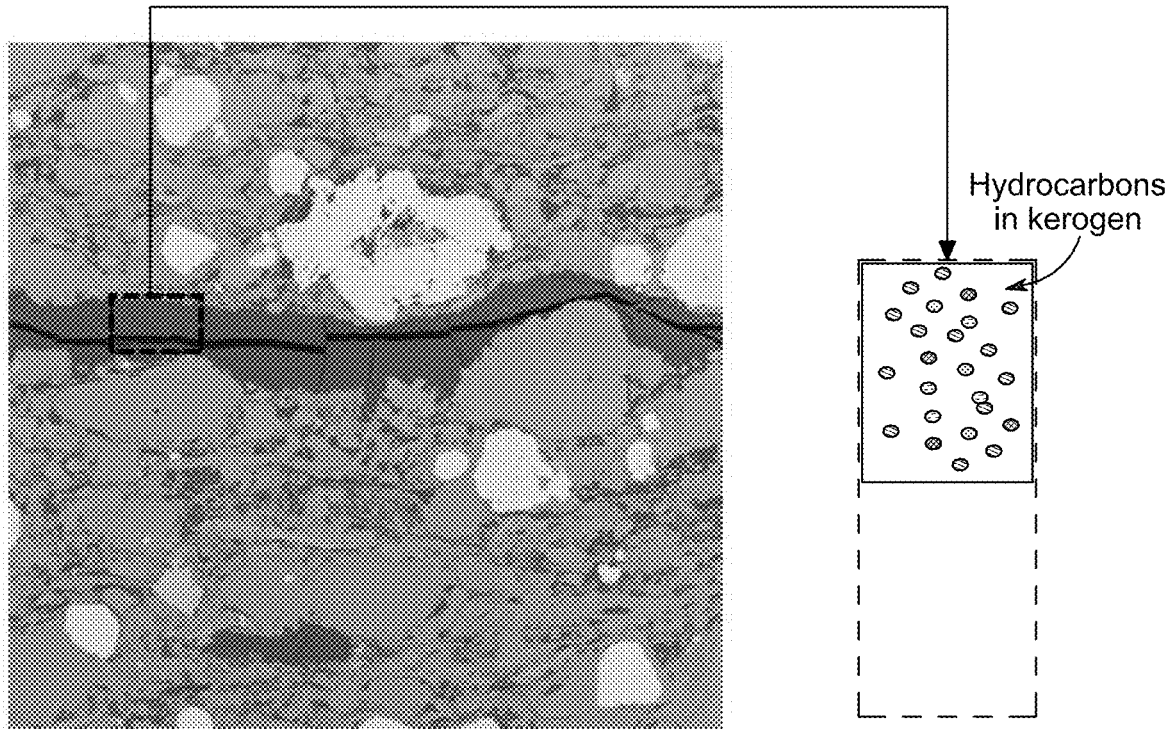
FIG. 4 shows a scanning electron microscope (SEM) image of the microcracks present in the reservoir, according to an aspect of the present disclosure.

FIG. 4 shows a scanning electron microscope (SEM) image of the microcracks present in the reservoir. A model was built based on repeated observations of close associations of organic materials and the microcracks. Hydrocarbons stored in the kerogen are subjected to pressure gradient when the formation is hydraulically fractured. During their continuous migration to the microcracks, the hydrocarbons are subjected to chemical and physical interactions with the kerogen surfaces. A molecular replication of the kerogen was prepared and then loaded with some arbitrary multi-component gas mixture. Subsequently, desorption simulations at typical reservoir temperatures were performed to mimic a depletion process. The same procedure was repeated at elevated temperatures. The goal was to closely monitor a compositional variations during the depletion of the shale matrix for both scenarios. Such approach may provide some insights into how heat-assisted depletion can improve overall productivity.

Example 2

Preparation of Kerogen Molecule Model

Figure 5:
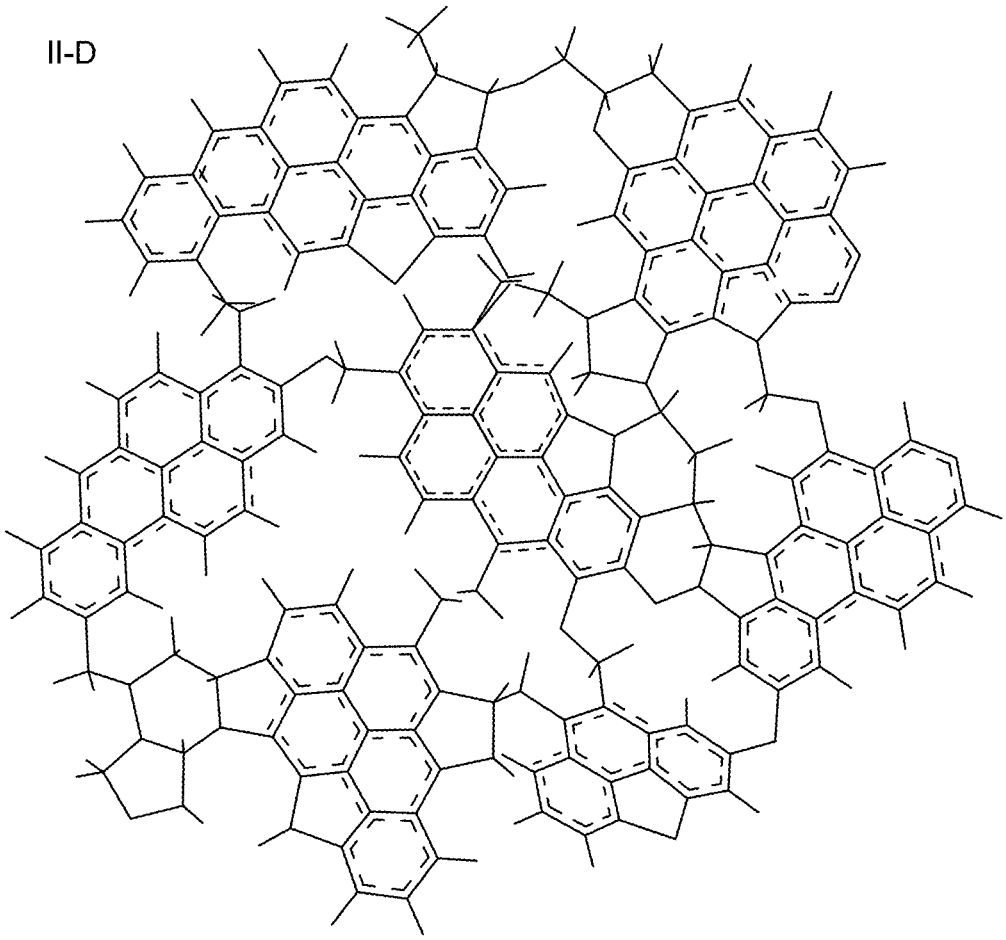
FIG. 5 shows a model of six kerogen molecules, according to an aspect of the present disclosure.

Six kerogen molecules corresponding to different levels of maturity were created [See: Ungerer P, Collell J, Yiannourakou M (2015) Molecular modeling of the volumetric and thermodynamic properties of kerogen: Influence of organic type and maturity. Energy and Fuels 29:91-105, incorporated herein by reference in its entirety]. FIG. 5 shows a model of six kerogen molecules. These molecules function as the building blocks for nanoporous organic materials. In the experiment, type I was built for immature kerogen. Four versions of type II were created with some variations in their origins. Type III is represented by one version which corresponds to coal. These models, which were created in a computational platform, were found to be within acceptable compositional agreement with experimental work. In performed experiment, type II-D, which corresponds to shale gas, was recreated, and used.

The molecular modeling approach used in the experiment is described, where a first subsection of the description provides details about building the type-II-D kerogen structures, a second subsection details the kerogen structure, characterization, and porosity estimation, and a last subsection shows a methodology in estimating the sorption of a multi-component system into the kerogen structure. All the previous parts were performed using the Measurements of Earth Data for Environmental Analysis (MedeA) environment while the MD used the Large-scale Atomic/Molecular Massively Parallel Simulator (LAMMPS) [See: Plimpton, S. Fast Parallel Algorithms for Short-Range Molecular Dynamics. J. Comput. Phys. 1995, 117, 1-19, incorporated herein by reference in its entirety].

Figure 6:
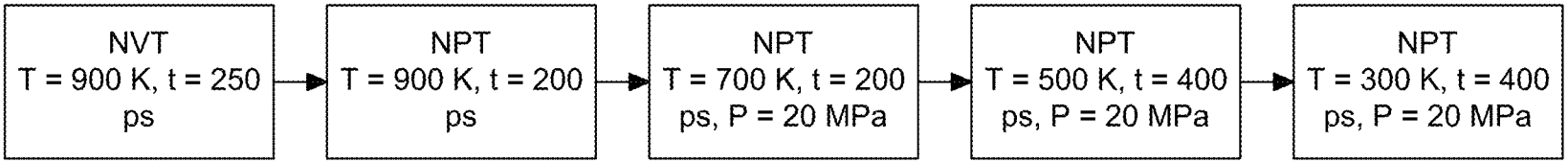
FIG. 6 illustrates exemplary NVT/NPT simulation parameters to obtain the kerogen type II-D molecule, according to an aspect of the present disclosure.

FIG. 6 shows simulation parameters to obtain the kerogen type II-D molecule. Building a condensed bulk kerogen for type-II-D was performed as discussed in Ungerer et al. [See: Ungerer P, Collell J, Yiannourakou M (2015): Molecular modeling of the volumetric and thermodynamic properties of kerogen: Influence of organic type and maturity. Energy and Fuels 29:91-105]. Nosé-Hoover thermostat and barostat were used for the temperature and pressure, respectively [See: Hoover, W. G. Constant-pressure equations of motion. Phys. Rev. A: At., Mol., Opt. Phys. 1986, 34, 2499-2500]. The Pcff+ force field is utilized for the molecular dynamic calculations [See: Yiannourakou, M.; Ungerer, P.; Leblanc, B.; Rozanska, X.; Saxe, P.; Vidal-Gilbert, S.; South, F.; Montel, F. Molecular simulation of adsorption in microporous materials. Oil Gas Sci. Technol. 2013, 68, 977-994, incorporated herein by reference in its entirety].

Pcff+ was shown to have excellent capability in describing the different kinds of interactions including dispersion and repulsion interactions (described by the Lennard-Jones) and Columbic interactions classical bond terms (stretching, bending, torsion) of different systems [See: Ungerer, P.; Rigby, D.; Leblanc, B.; Yiannourakou, M. Sensitivity of the aggregation behavior of asphaltenes to molecular weight and structure using molecular dynamics. Mol. Sim. J. 2014, 40 (1-3), 115-122; Ungerer P, Collell J, Yiannourakou M (2015) Molecular modeling of the volumetric and thermodynamic properties of kerogen: Influence of organic type and maturity. Energy and Fuels 29:91-105]. A cutoff at 1.2 nm was utilized for the electrostatic interactions during the equilibration calculations. The average was obtained by the Particle-Particle-Particle-Mesh method at the final temperature of the calculation [See: Plimpton, S. Fast Parallel Algorithms for Short-Range Molecular Dynamics. J. Comput. Phys. 1995, 117, 1-19; Beckers, J. V. L.; Lowe, C. P.; DeLeeuw, S. W. An iterative PPPM method for simulating coulombic systems on distributed memory parallel computers. Mol. Simul. 1998, 20 (6), 369-383. (42); Hockney, R. W.; Eastwood, J. W. Computer Simulation Using Particles; McGraw-Hill: New York, 1981, incorporated herein by reference in its entirety].

Initially, five kerogen units were placed inside a simulation box of 0.3 g/cc. Several consecutive relaxations were performed to build the dense kerogen structure. Starting with NVT simulation at a temperature of 900 K for 250 psi, followed by four NPT simulations with stepwise decreasing the temperature from 900 K to 300 K at a constant pressure of 20 MPa, the time step used in all calculations was 1 femtosecond (fs). At final conditions of pressure and temperature, the density was calculated to be around 1-1.2 g/cc. After constructing the kerogen structure, the porosity was estimated by the simulating helium pycnometry method. The helium pycnometry method measured the effective pore volume by the adsorption of helium which is assumed to be negligible [See: Zhang, T., Ellis, G. S., Ruppel, S. C., Milliken, K., Yang, R., (2012). Effect of organic-matter type and thermal maturity on methane adsorption in shale-gas systems. Organic Geochemistry. 34:120-131; Tian, Y. Yan, C., Jin, Z., (2017). Characterization of Methane Excess and Absolute Adsorption in Various Clay Nanopores from Molecular Simulation. Scientific Reports 7: 1-21, incorporated herein by reference in its entirety]. The porosity was found to be 19%.

Example 3

The nanoporous material was loaded with a mixture of C1-C4 at a pressure of 2500 psi and at a temperature equal to 194° F. (i.e., typical reservoir temperature). A bulk phase composition was arbitrarily selected to be 0.3, 0.15, 0.2, and 0.35 of the four alkanes, respectively. The initial composition of the mixture was 0.673, 0.255, 0.0073, and 0.065 respectively as shown in Table 2.

TABLE 2

Bulk phase composition to load kerogen with molecules

| Component | Composition | Fugacity (psi) |
|---|---|---|
| $CH_4$ | 30% | 1061.1 |
| $C_2H_6$ | 15% | 195.7 |
| $C_3H_8$ | 20% | 123.4 |
| n-$C_4H_{10}$ | 35% | 106.2 |

The sorption of the different components was obtained by using Grand Canonical ensemble [See: Nicholson D., Parsonage N. G. (1982) Computer simulation and the statistical mechanics of adsorption, Academic Press, New York, USA, incorporated herein by reference in its entirety]. The parameters of such ensemble are the adsorbed molecule chemical potential, volume, and temperature. The fugacity was imposed for each component (i.e., since its gas mixture with relatively high pressure) which is equivalent to using the chemical potential as the following:

$$\mu_i = \mu_{io} + RT\ln\left(\frac{f_i}{f_{io}}\right) \tag{1}$$

where $\mu_i$, $\mu_{io}$, R, T, $f_i$, $f_{io}$ are the chemical potential for component i, the ideal chemical potential for component i, gas constant, temperature, fugacity of component i, and ideal fugacity of component i, respectively. All the adsorbent components were treated as rigid except C1 due to the high fugacity value. Rigid type simplifies the problem since there is no need to consider the solid-solid interactions energy [See: Yiannourakou, M., Ungerer, P., Leblanc, B., Rozanska, X., Saxe, P., Gouth, F., Montel, F. (2013). Molecular Simulation of Adsorption in Microporous Materials. Molecular Simulation 68: 977-994, incorporated herein by reference in its entirety].

Kerogen type II-D molecule shown in FIG. 6 was recreated at the molecular platform and the nanoporous material was created following the description provided in the previous section. Porosity was selected to be 19.6% by adding 10 molecules of heptane during the construction phase and then deleting them afterward. Table 3. shows the initial composition of the loaded kerogen at 2500 psi.

TABLE 3

Composition of Loaded Kerogen

| $CH_4$ | $C_2H_6$ | $C_3H_8$ | n-$C_4H_{10}$ |
|---|---|---|---|
| 67.30% | 25.50% | 0.73% | 6.50% |

Figure 7:
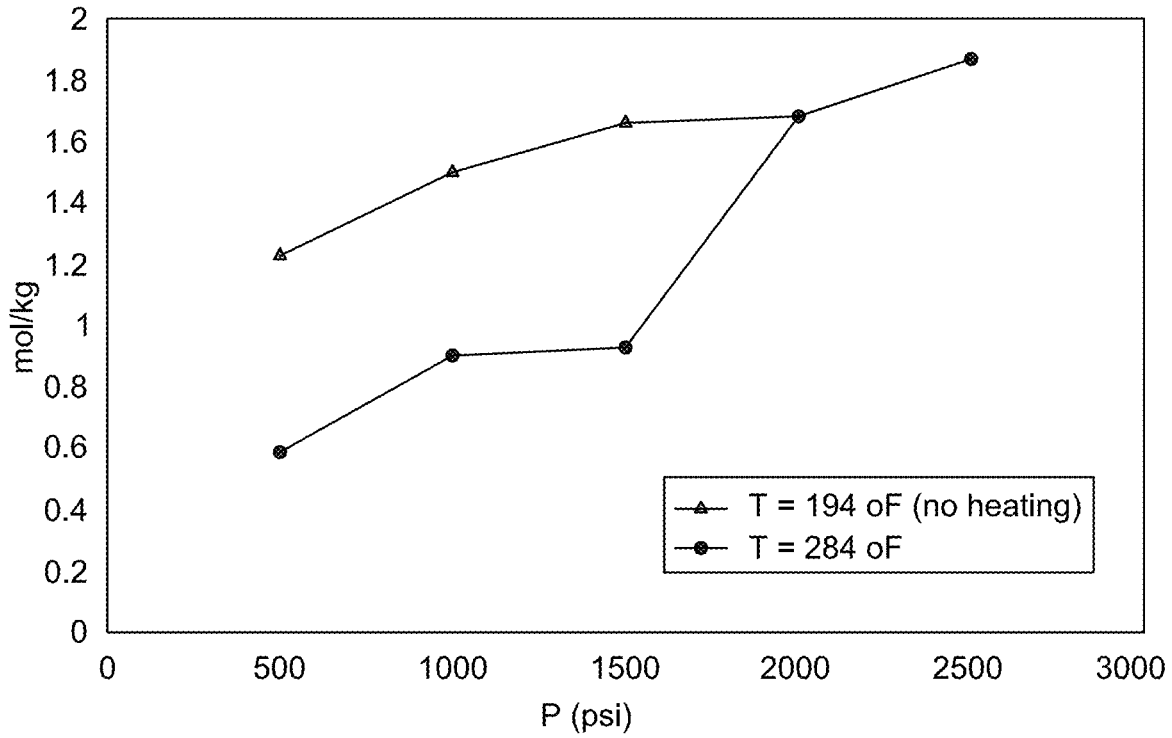
FIG. 7 is a graph showing adsorption as a function of pressure at typical reservoir temperature and at elevated temperature, according to an aspect of the present disclosure.

FIG. 7 shows adsorption as a function of pressure at typical reservoir temperature and at elevated temperature. Desorption of hydrocarbons was carried out at a typical reservoir temperature of 194° F. and then at 284° F. During the desorption stages, a number of molecules of each component were monitored for further analysis. The total number of desorbed molecules for both cases is given in FIG. 7. The recovery factor RF is calculated as:

$$RF = 1 - \frac{n}{n_i} \tag{2}$$

where n is the total number of molecules present at a given depletion stage and $n_i$ is the initial number of molecules present at initial conditions. The ultimate recovery factor at the last desorption was 36% while that of the heated case is almost 70% indicating an improved recovery by two times.

Figure 8:
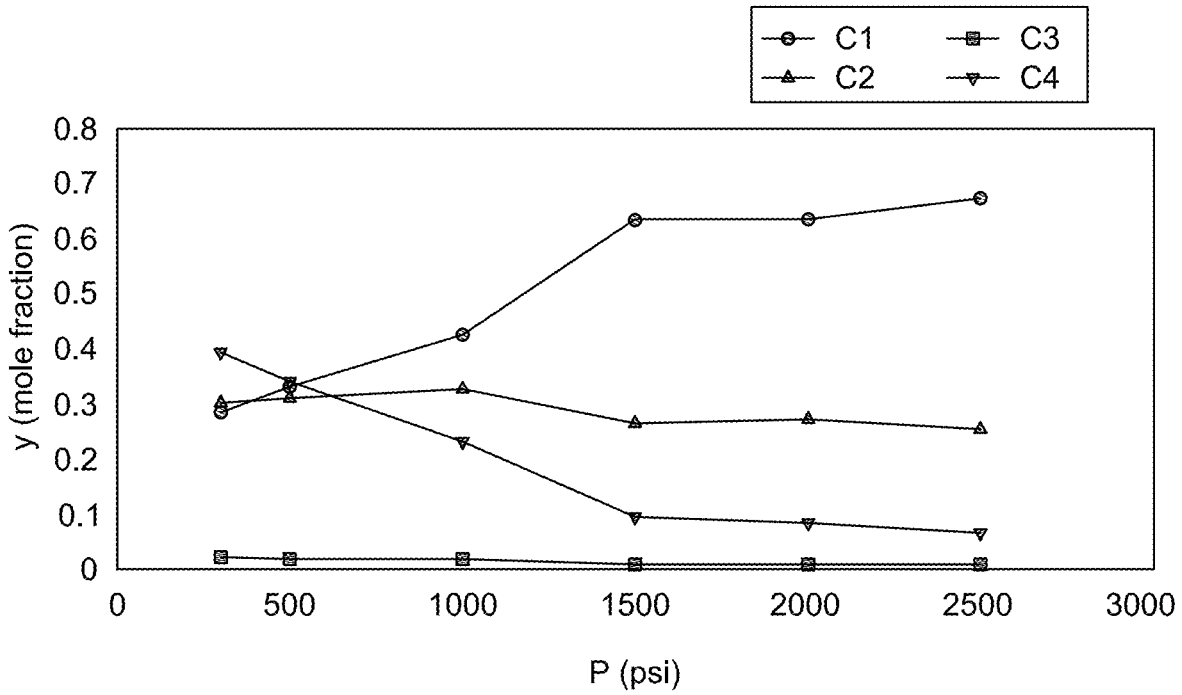
FIG. 8 is a graph showing a compositional variation for desorption stages at a typical reservoir temperature of 194° F., according to an aspect of the present disclosure.
Figure 9:
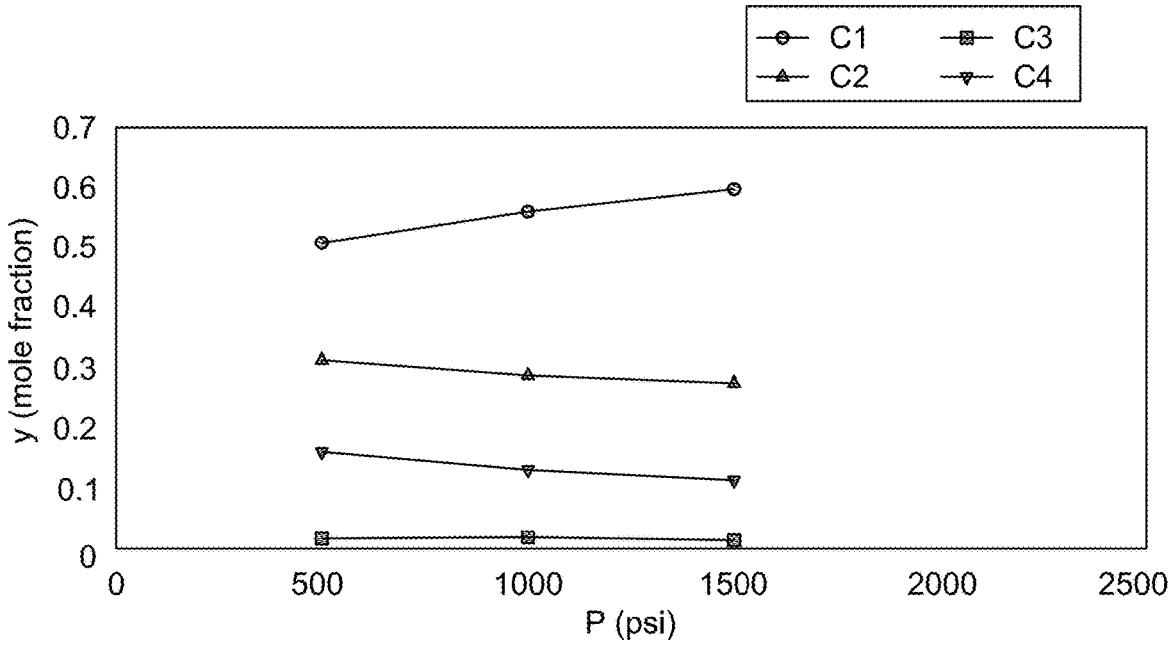
FIG. 9 is a graph showing a compositional variation for desorption stages at elevated reservoir temperature of 284° F., according to an aspect of the present disclosure.
Figure 10:
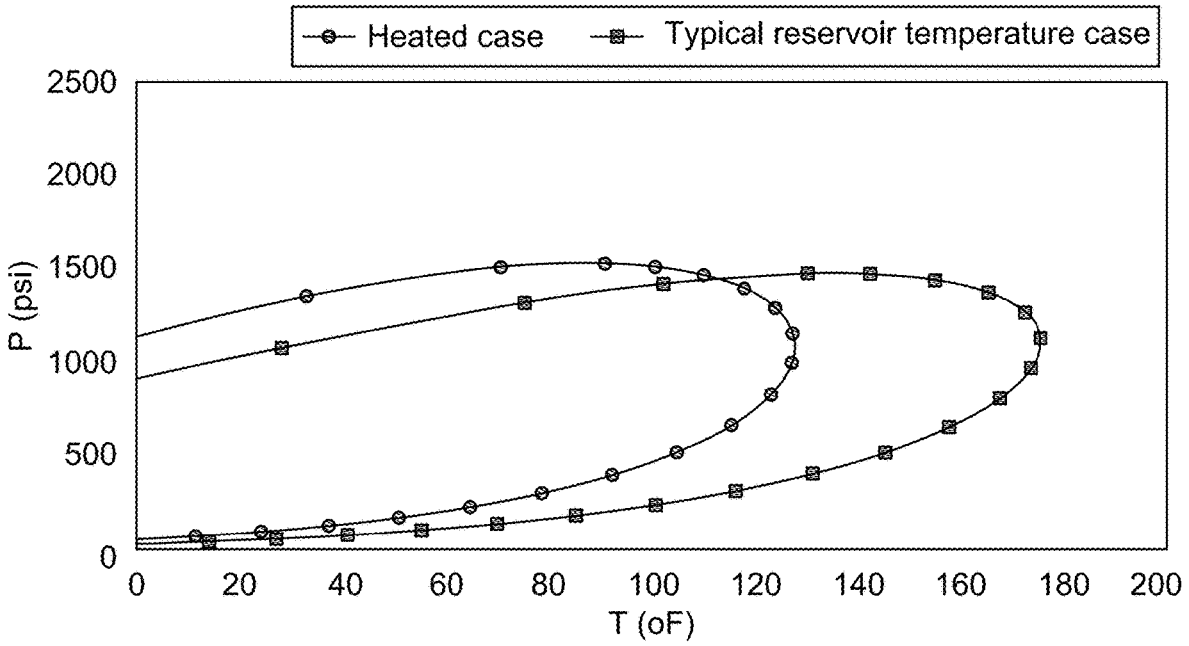
FIG. 10 illustrates a P-T diagram at a 4th desorption stage for both heated and typical reservoir cases, according to an aspect of the present disclosure.
Figure 11:
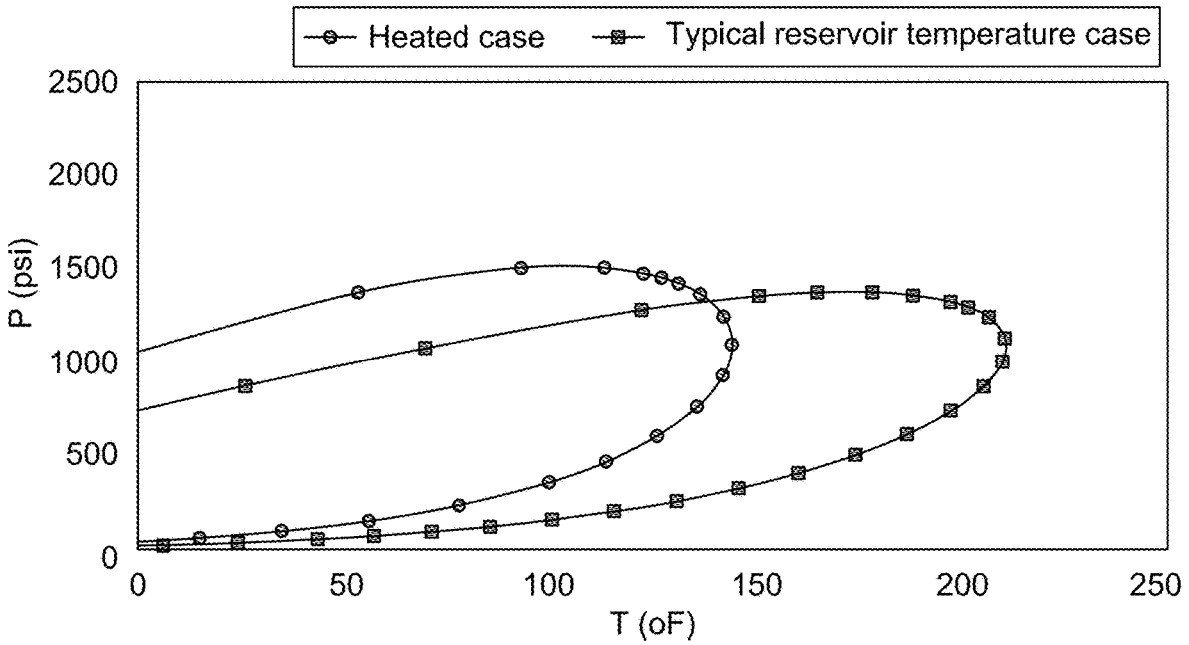
FIG. 11 illustrates a P-T diagram at a 5th desorption stage for both heated and typical reservoir cases, according to an aspect of the present disclosure.

FIG. 8 shows compositional variation for desorption stages at a typical reservoir temperature of 194° F. and FIG. 9 shows compositional variation for desorption stages at an elevated reservoir temperature of 284° F. The compositional variations at each pressure stage were obtained for typical reservoir and heated temperature cases as given in FIG. 8 and FIG. 9 respectively. For the typical reservoir temperature, the lightest component which is methane is selectively desorbed leaving other heavier molecules behind. The extent of that fractionation becomes more pronounced below saturation pressure (i.e., maximum adsorption capacity pressure). On the other hand, the fractionation effect is less severe for the heated case as components maintained almost constant composition during desorption stages. FIG. 10 shows the P-T diagram at a $4^{th}$ desorption stage for both heated and typical reservoir cases and FIG. 11 shows the P-T diagram at a $5^{th}$ desorption stage for both heated and typical reservoir cases. The influence of compositional variations on the phase behavior is obtained by obtaining a P-T diagram for the given composition of both cases at two stages of depletions as shown in FIG. 10 and FIG. 11 respectively.

Example 4

Reservoir Scale Heat Transfer Model

Figure 12:
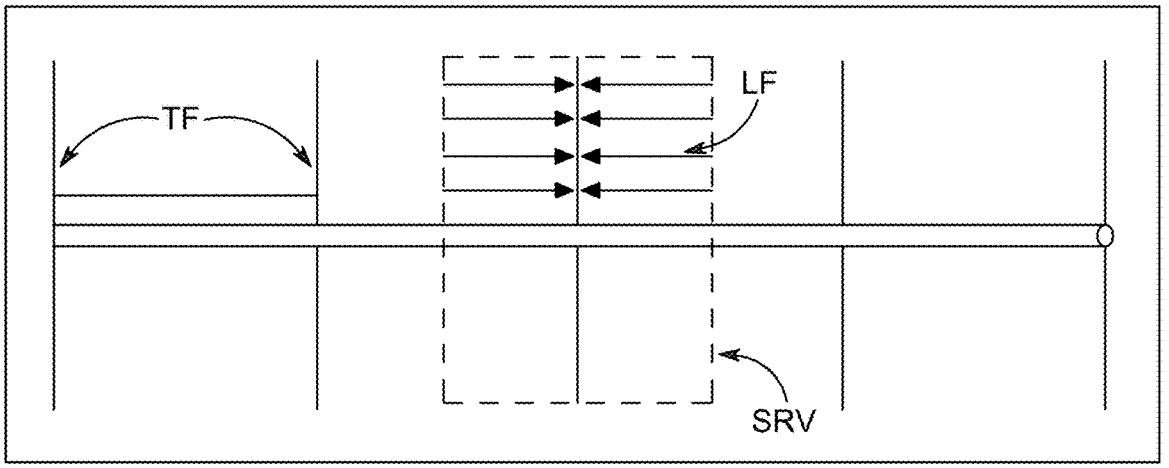
FIG. 12 is a schematic view of multistage hydraulic fracturing and stimulated reservoir volume (SRV), according to an aspect of the present disclosure.

FIG. 12 shows a schematic view of multistage hydraulic fracturing and simulated reservoir volume "SRV". The feasibility of heating an unconventional reservoir by either injecting hot gas or by introducing a heating element was investigated. This model considers a transverse fractures "TF" intersecting a lateral wellbore created by multistage hydraulic fracturing (MSF) as shown in FIG. 12. It also assumed that a 30 ft spacing between hydraulic fractures along 4500 ft long lateral was designed, producing 150 transverse fractures. The fracture half-length was 400 ft while the fracture height was 150 ft. Due to symmetry, a simulation domain was half of the simulated reservoir volume "SRV" shown in FIG. 12.

A coupled heat and mass transfer model was used to study the heat propagation while injecting hot fluids. The detailed mathematical description is given below. The reservoir temperature was around 200° F. while the gas was heated to 400° F. before injection. The thermal properties of the reservoir rock and fluids are shown in Table 4. The gas injector was simulated in this case to understand the heat propagation given that the producer was neglected. It was found that the hot gas can advance heat to a sufficient distance when a considerable amount is being injected for long periods.

An integrated flow and heat transfer model was developed for a system containing a wellbore, fracture, and reservoir. These were integrated through shared boundary conditions. A mathematical description of each model is shown below. The wellbore model is transient one-dimensional (1D) and projected to estimate the temperature of the fluid incoming to the fracture from the wellbore. The wellbore model is numerically coupled with a reservoir model to estimate the heat transfer from the wellbore to the surrounding formation. To obtain a velocity profile in the wellbore, the following continuity equation is solved:

$$\frac{\partial \rho_f}{\partial t} = \frac{2\gamma}{R_w}\rho_f v_{L,p} - \frac{\partial(\rho_f v_Z)}{\partial z} \tag{3}$$

where t is injection time, $R_w$ is the wellbore radius, $\rho_f$ is the injected fluid density, $\gamma$ is the wellbore open ratio, $v_{L,p}$ is the velocity of fluids entering the fracture and z is the direction along wellbore length. Obtaining the velocity profile makes it possible to solve the wellbore energy balance equation. The heat transfer equation within the wellbore can be written as:

$$\rho_f \hat{C}p_f\left(\frac{\partial T_{wb}}{\partial t} + v_Z\frac{\partial T_{wb}}{\partial z} + \frac{2\gamma}{R}v_{L,p}(T_{wb} - T_{f|B})\right) = \frac{2(1-\gamma)U}{R_w}(T_{r|B} - T_{wb}) \tag{4}$$

where $T_{wb}$ is the temperature of the wellbore, $\hat{C}p_f$ is the fluid's specific heat capacity, $T_{f|B}$ is the fracture temperature at the wellbore/fracture boundary, U is the overall heat transfer coefficient between the wellbore and formation, and $T_{r|B}$ is the temperature at the wellbore/formation (i.e., reservoir) boundary. The subscript B is used to represent the value at the boundary of the wellbore, reservoir, and fracture.

Solving Equation 4 requires information about the fracture and formation temperatures. A procedure that requires iteration was implemented to solve the complete system. The geothermal temperature was considered as the initial condition. The radial reservoir heat conduction model was coupled along the wellbore, which can be written as:

$$\overline{\rho\hat{C}p}\frac{\partial T_r}{\partial t} = \frac{1}{r}\frac{\partial}{\partial r}\left(r\bar{k}_e\frac{\partial T_r}{\partial r}\right) + \bar{k}_e\frac{\partial^2 T_r}{\partial z^2} \tag{5}$$

where $\overline{\rho\hat{C}p}$ is the average reservoir rock and fluid property, $\overline{k_e}$ is the effective average thermal conductivity, and r is the radial direction away from the wellbore.

During injection, the fluid loss from the fracture induces fluid flow in the reservoir. A flow in the coupled fracture/reservoir system can be estimated by solving diffusivity equation for compressible fluids, written as:

$$\nabla\cdot(k_{nD}\nabla m(p)) = \varphi\mu c_t\frac{\partial m(p)}{\partial t} \tag{6}$$

where $k_{nD}$ is the non-Darcy permeability, $\varphi$ is the formation porosity, $c_t$ is the total compressibility and m(p) is the pseudo-pressure function.

That enables solving the heat transfer model in the reservoir/fracture system which can be described as:

$$\left(\rho_f\hat{C}p_f\frac{\partial T_r}{\partial t} + -\varphi\beta_T T_r\frac{\partial p}{\partial t} + \rho_f\hat{C}p_f v\cdot\nabla T_r\right) = \nabla\cdot(k_f\nabla T_r) + (\beta_T T_r - 1)v\cdot\nabla p \tag{7}$$

where $\beta_T$ is the thermal expansion factor, v is the velocity vector, $k_f$ is the fluid's thermal conductivity vector, and p is the formation pressure. The first term in the above equation represents the accumulation of heat in the fracture, the second term is heat convection, and the last term is heat conduction.

TABLE 4

Thermal properties of reservoir rock and fluids

| Input Data | SI Unit | Field Unit |
|---|---|---|
| Ambient temperature, $T_b$ | 25° C. | 77° F. |
| Reservoir temperature, $T_R$ | 93.33° C. | 200° F. |
| The gas temperature at injection or element temperature, $T_I$ | 204.4° C. | 400° F. |
| Formation specific heat capacity, $c_{ma}$ | 0.879 kJ/(Kg ° C.) | 0.2099 Btu (lb. ° F.) |
| Formation thermal conductivity, $k_{ma}$ | $1.57 \times 10^{-3}$ kJ/(s · m. ° C.) | 0.907 Btu/(hr · ft. ° F.) |
| Gas heat capacity, $c_p$ | 2.18 kJ/(Kg ° C.) | 0.52 Btu/(lbm ° F.) |
| Gas thermal conductivity, k | $5.5 \times 10^{-5}$ kJ/(s · m. ° C.) | 0.0318 Btu/(hr · ft. ° F.) |
| Overall heat transfer coefficient, U | 0.1 kJ/(s · $m^2$ ° C.) | 0.00488 Btu/(hr · $ft^2$ ° F.) |

Figure 13B:
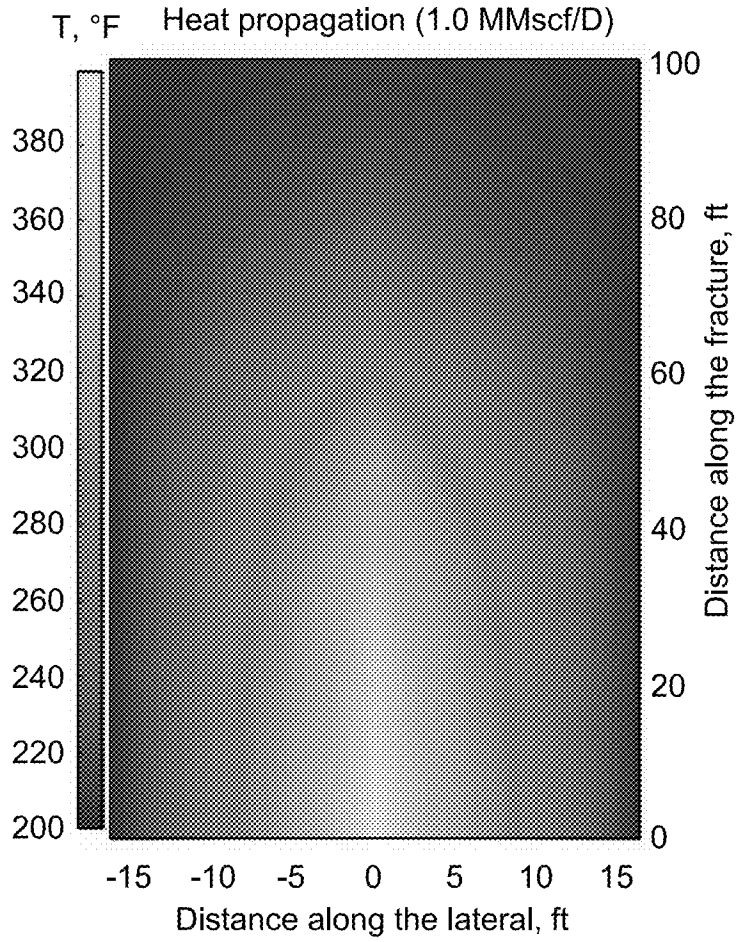
FIG. 13B illustrates heat propagation within the SRV when injecting a hot fluid at 1.0 MMscf/D, according to an aspect of the present disclosure.
Figure 13A:
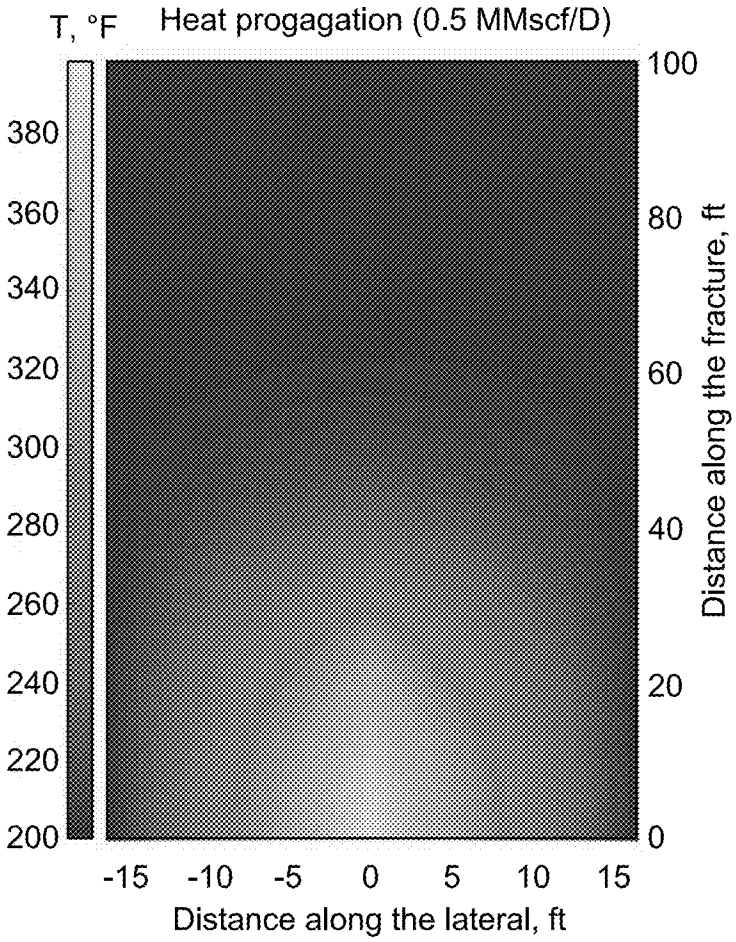
FIG. 13A illustrates heat propagation within the SRV when injecting a hot fluid at 0.5 MMscf/D, according to an aspect of the present disclosure.

FIG. 13A shows a heat propagation at a steady-state condition when injecting 0.5 MMscf/D of hot gas and FIG. 13B shows a heat propagation at a steady-state condition when injecting 1.0 MMscf/D of hot gas. The hydraulic fracture (one wing) is placed in the middle of the x-axis (0 location). As expected, most of the heating occurred within the fracture surroundings. Also, the larger the injection rate, the longer the heat penetration distance.

Figure 14A:
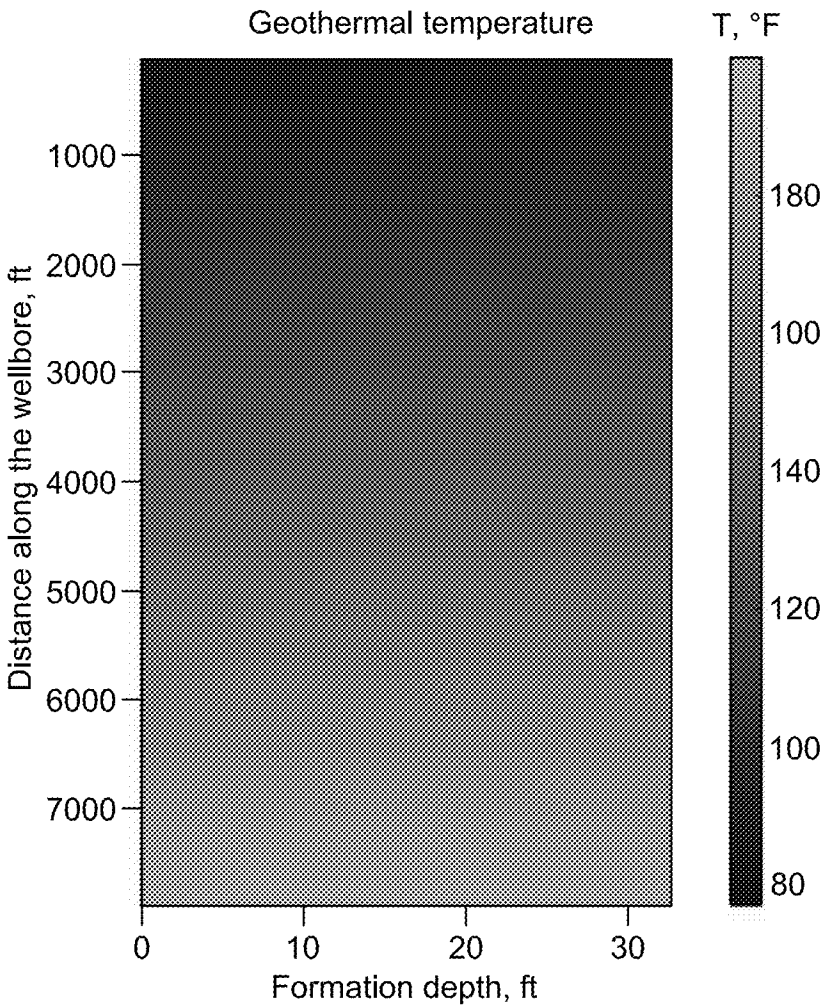
FIG. 14A shows an initial geothermal temperature distribution around a vertical wellbore section, according to an aspect of the present disclosure.
Figure 14B:
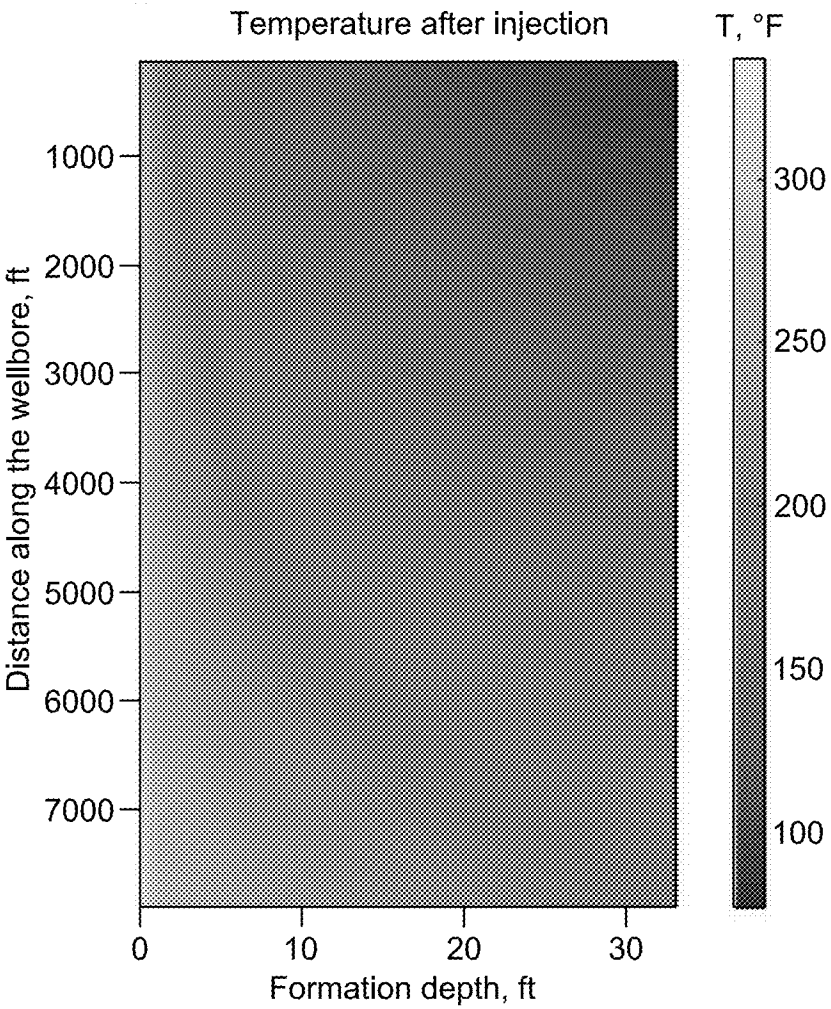
FIG. 14B shows formation temperature distribution around the vertical wellbore section after injection of the hot fluid, according to an aspect of the present disclosure.

Hot gas injection is not feasible for many reasons. A process of gas injection is very expensive and could cause severe corrosion when $CO_2$ is the selected gas. Also, a practice of heating gas while injection and separating it after production is costly and unpractical. A considerable amount of gas must be injected; despite that, the heat does not fully propagate to a tip of the fracture. A large amount of heat could be lost around the wellbore, especially if it has to travel a long distance before reaching the perforation clusters. FIG. 14A shows an initial geothermal temperature around the vertical wellbore section and FIG. 14B shows an after-injection temperature around the vertical wellbore section. It may be observed that the wellbore is placed on the west edge of the figure. As can be observed from the temperature magnitudes, a large amount of heat is lost to the formation before the hot fluids reached the fracture.

Figure 15A:
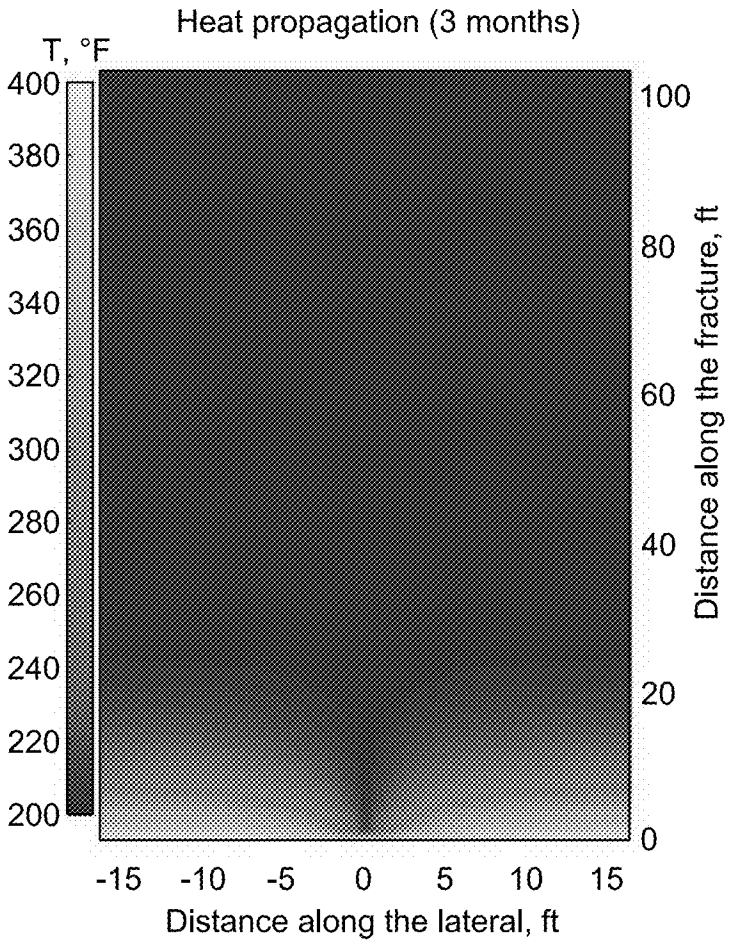
FIG. 15A illustrates heat propagation (for 3 months) within the SRV when placing a heating element at different heating times, according to an aspect of the present disclosure.
Figure 15B:
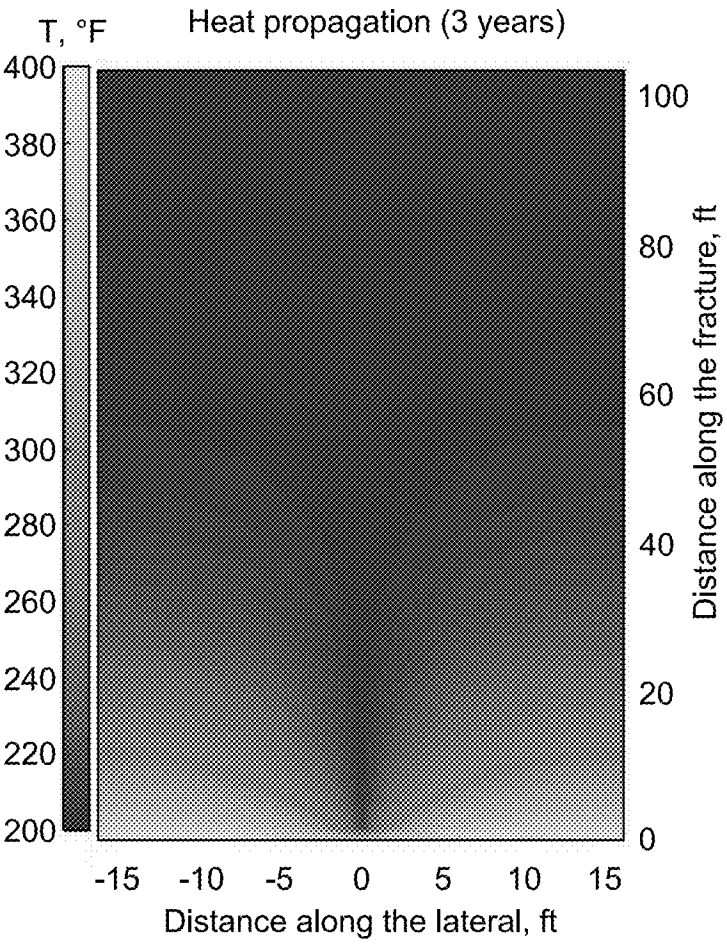
FIG. 15B illustrates heat propagation (for 3 years) within the SRV when placing the heating element at different heating times, according to an aspect of the present disclosure.

FIG. 15A shows a three-month heat propagation within the SRV when placing a heating element and FIG. 15B shows a three-year heat propagation within the SRV when placing a heating element. Placing the heated element around the lateral section of the wellbore was another option. The heated element was permanently placed at a constant temperature of 400° F. while the reservoir is under production (10 MMscf/D). The heating element was considered as a constant temperature boundary condition at the south side of the domain as shown in FIG. 15A and FIG. 15B. A feasibility of the heated element arises from two facts—first, the heating propagation from the element into the reservoir does not act against the formation linear advection direction, and second, heat propagation, in this case, is transient and keeps reaching new fronts as time progresses. It was found that the heat propagation did not terminate while the heated element is operating and a mechanism at which the heat propagated was through conduction within the formation's rock and fluids. In contrast to the previous scenario, the heat propagated almost equally through the SRV except around the producing fractures. The reason was that the fluids were advected against the heat propagation only within the fracture.

Figure 16B:
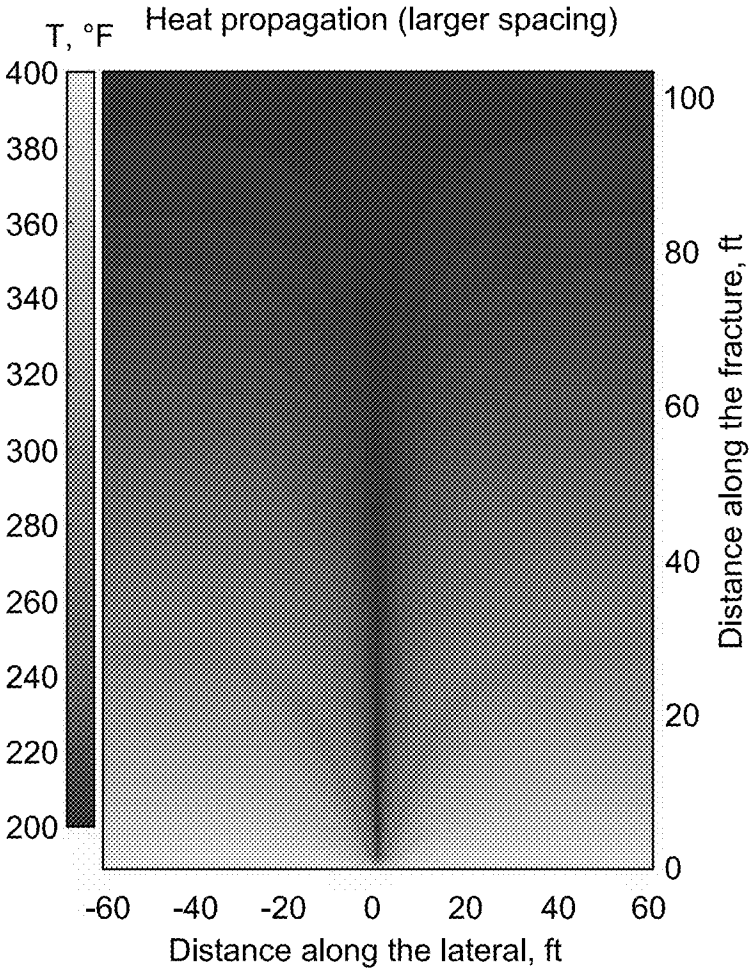
FIG. 16B illustrates heat propagation within the SRV when placing the heating element at a lower production rate (10 MMscf/D) and at a larger fracture spacing, according to an aspect of the present disclosure.
Figure 16A:
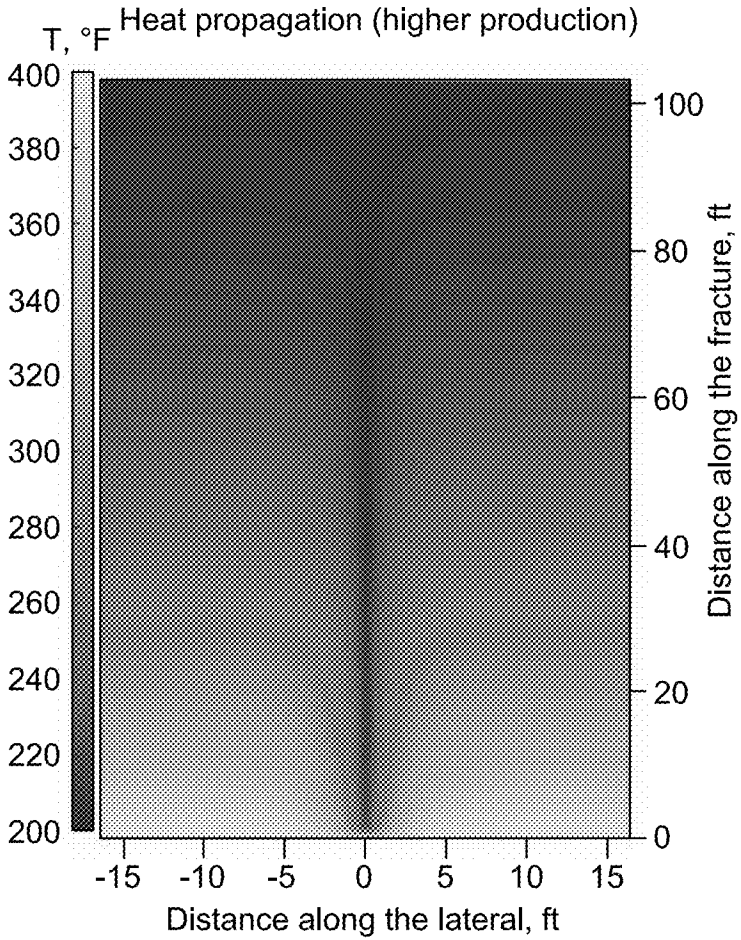
FIG. 16A illustrates heat propagation within the SRV when placing the heating element at a high production rate (100 MMscf/D), according to an aspect of the present disclosure.

FIG. 16A shows heat propagation within the SRV when placing a heating element at a high production rate (100 MMscf/D) and FIG. 16B shows heat propagation within the SRV when placing a heating element at a lower production rate (10 MMscf/D) and at a larger fracture spacing. Besides the heating time, two other factors can influence heat propagation. First, the advection rate can significantly enhance heat transfer within the SRV causing the heat to reach longer distances. FIG. 16A shows the temperature map when the lateral was assumed to produce at 100 MMscf/D. The heat reached around 90 ft along the fracture direction while only 55 ft for the 10 MMscf/D production case (see FIG. 15B). Also, increasing the spacing between fractures was found to enhance the heat propagation, as shown in FIG. 16B, due to the SRV receiving high heat flux which improves the efficiency of heat transfer.

The invention claimed is:

1. A method of hydrocarbon recovery, the method comprising:

A. providing a gaseous hydrocarbons formation heating device comprising:

i) a plurality of heating elements permanently installed on production tubing in a wellbore of a gaseous hydrocarbons formation comprising a reservoir of gaseous hydrocarbons operably linked to the production tubing, wherein the plurality of heating elements comprises a pair of individual, independently controllable heating elements configured such that the plurality of heating elements provide the production tubing a temperature profile that is non-cylindrically symmetrical;

ii) a controller configured to control temperature of the plurality of heating elements; and iii) a plurality of sensors, each of the sensors configured to a. measure a parameter selected from a group consisting of a temperature profile of the plurality of heating elements, a temperature distribution of liberated gaseous hydrocarbons in the production tubing, and a gaseous hydrocarbons flow profile of liberated gaseous hydrocarbons in the production tubing; and b. transmit input signals to the controller reflecting the measured parameter; and B. heating the plurality of heating elements and increasing the temperature of the plurality of heating elements to between 200 to 325° F. for a heating period to propagate heat into the reservoir of gaseous hydrocarbons;

C. adjusting with the controller the temperature of the plurality of heating elements during the heating period based on the signals transmitted to the controller from the plurality of sensors; and thereby providing the production tubing the non-cylindrically symmetrical temperature profile, creating a zone of heated hydrocarbons adjacent the production tubing and generating the liberated gaseous hydrocarbons;

wherein the zone of heated hydrocarbons encompasses a hydraulic fracture;

wherein the heat propagated into the reservoir of gaseous hydrocarbons is transient, keeps reaching new fronts throughout the heating period, and extends to a length of the hydraulic fracture comprising from 55 to 90 feet during the heating period; and D. recovering the liberated gaseous hydrocarbons by transporting the liberated gaseous hydrocarbons from the production tubing to the Earth's surface.

2. The method of claim 1, wherein the temperature profile of the plurality of heating elements is continuously monitored by the controller based on the input signals from the sensors.

3. The method of claim 1, wherein the recovering of the liberated gaseous hydrocarbons is at a rate of from 10 million standard cubic feet per day (MMSCFD) to 100 MMSCFD.

4. The method of claim 1, wherein a recovery factor of the gaseous hydrocarbons formation increases by from 15% to 50% compared to a gaseous hydrocarbons formation which is not heated.

5. The method of claim 4, wherein a bottomhole pressure required to maintain a production rate of the gaseous hydrocarbons formation is lowered by 250 to 1250 PSI compared to a gaseous hydrocarbons formation which is not heated.

6. The method of claim 1, wherein a bottomhole pressure required to maintain a production rate of the gaseous hydrocarbons formation is lowered by 250 to 1250 PSI compared to a gaseous hydrocarbons formation which is not heated.

* * * * *